US008116660B2

(12) United States Patent
Watanabe

(10) Patent No.: US 8,116,660 B2
(45) Date of Patent: Feb. 14, 2012

(54) IMAGE FORMING APPARATUS

(75) Inventor: Toshiyuki Watanabe, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 299 days.

(21) Appl. No.: 12/580,421

(22) Filed: Oct. 16, 2009

(65) Prior Publication Data

US 2010/0098457 A1 Apr. 22, 2010

(30) Foreign Application Priority Data

Oct. 22, 2008 (JP) ..... 2008-271781

(51) Int. Cl.
*G03G 21/16* (2006.01)

(52) U.S. Cl. ..... 399/111

(58) Field of Classification Search ..... 399/107, 399/110, 111, 113, 119
See application file for complete search history.

(56) References Cited

U.S. PATENT DOCUMENTS

| | | | | |
|---|---|---|---|---|
| 5,608,498 | A | 3/1997 | Nagase et al. | 399/130 |
| 6,349,182 | B2 | 2/2002 | Otsubo et al. | 399/12 |
| 7,486,907 | B2 | 2/2009 | Noguchi et al. | 399/110 |
| 2006/0067734 | A1 * | 3/2006 | Igarashi et al. | 399/119 |
| 2007/0147890 | A1 | 6/2007 | Hayakawa | 399/119 |
| 2007/0160388 | A1 * | 7/2007 | Yoshimura et al. | 399/111 |

FOREIGN PATENT DOCUMENTS

| | | |
|---|---|---|
| JP | 2007-178482 | 7/2007 |

* cited by examiner

*Primary Examiner* — David Gray
*Assistant Examiner* — Billy J Lactaoen
(74) *Attorney, Agent, or Firm* — Fitzpatrick, Cella, Harper & Scinto

(57) ABSTRACT

An image forming apparatus for forming an image on a recording material includes a cartridge, a main assembly including a positioner positioning the cartridge and an urger urging the cartridge to the positioner, a mover supporting the cartridge and movable between a pulled out position outside of the main assembly and an inside position inside the main assembly, and a gripper mounted to the mover and movable between a reference position and an outward position located outwardly with respect to the pull out direction of the mover. When the mover is at the inside position, the cartridge is positioned to the positioner by the urger to be placed in a positioning state when the gripper is at the reference position and the positioning state of the cartridge is released by moving the gripper from the reference position to the outward position.

8 Claims, 13 Drawing Sheets

(a) 31-CLOSED 36-CLOSED (b) 31-OPENED 36-CLOSED (c) 31-OPENED 36-OPENED

IMAGE FORMING APPARATUS

FIELD OF THE INVENTION AND RELATED ART

The present invention relates to an image forming apparatus, to which a cartridge is detachably mountable, for forming an image on a recording material (medium).

The image forming apparatus includes, e.g., those of an electrophotographic type, an electrostatic recording type, a magnetic recording type, and the like, such as a copying machine, a printer (a laser beam printer, an LED printer, or the like), a facsimile machine, a word processor, and the like.

The cartridge includes at least one of an image bearing member on which a latent image is to be formed and a developing means for developing the latent image formed on the image bearing member with a developer and is detachably mountable to an apparatus main assembly. The apparatus main assembly is a portion of the image forming apparatus except the cartridge and a movable member for moving the cartridge. The cartridge is mountable to and demountable from the apparatus main assembly by a user himself (herself). For that reason, maintenance of the apparatus main assembly can be easily performed.

The image bearing member is a member on which the latent image (such as an electrostatic latent image, a potential latent image, a resistance latent image, or a magnetic latent image) is to be developed with the developer is formed. Examples of the image bearing member may include an electrophotographic photosensitive member (photoconductor) in an electrophotographic process, an electrostatic recording dielectric member in an electrostatic recording process, and a magnetic recording magnetic member in a magnetic recording process.

As an exchanging method of the cartridge with respect to the apparatus main assembly of the image forming apparatus, U.S. Pat. No. 5,608,498 discloses the following constitution. That is, a cartridge 30 is supported through a guide member 70 capable of elongating and contracting in two steps with respect to an ascending/descending board 61 which is moved forward and backward and up and down in interrelation with a side surface cover 80. The cover 80 is opened to raise and move the cartridge 30 from an image forming position (I) to a pull-out position (II), and then the cartridge 30 is directly pulled out. By the pulling-out, the cartridge 30 is optionally moved to a position including a stopping position (III) so as to perform mounting/demounting of each device and jammed paper processing.

Further, U.S. Patent Application Publication No. 2007/0147890 discloses a constitution in which a plurality of cartridges is supported by a movable member movable with respect to the apparatus main assembly. According to this constitution, by inserting the movable member into the apparatus main assembly, the plurality of cartridges can be inserted simultaneously into the apparatus main assembly. Further, the movable member is pulled out from the apparatus main assembly and then a desired cartridge can be demounted from the member and can be replaced with a fresh cartridge.

SUMMARY OF THE INVENTION

The present invention have further developed the above-described conventional constitutions.

A principal object of the present invention is to improve usability in a cartridge exchange constitution and to improve operativity of maintenance such as jam clearance.

According to an aspect of the present invention, there is provided an image forming apparatus for forming an image on a recording material, comprising:

a cartridge including at least one of an image bearing member on which a latent image is to be formed and developing means for developing with a developer the latent image formed on the image bearing member;

a main assembly including a positioning portion for positioning the cartridge and an urging member for urging the cartridge so that the cartridge is positioned to the positioning portion;

a movable member movable, with respect to the main assembly in a state in which the movable member supports the cartridge, between a pulled-out position in which the movable member is pulled out to an outside of the main assembly to position the cartridge outside the main assembly and an inside position in which the cartridge is positioned inside the main assembly; and a grip member, which is mounted to the movable member and which is to be gripped for pulling out the movable member, movable between a reference position and an outward position located outwardly the reference position with respect to a pull-out direction in which the movable member is pulled out from the inside position to the pulled-out position;

wherein in a state in which the movable member is located at the inside position, the cartridge is positioned to the positioning portion by the urging member to be placed in a positioning state when the grip member is located at the reference position, and wherein in the state in which the movable member is located at the inside position, the positioning state of the cartridge is released by moving the grip member from the reference position to the outward position.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Embodiment 1

General Structure of Image Forming Apparatus

Figure 1:
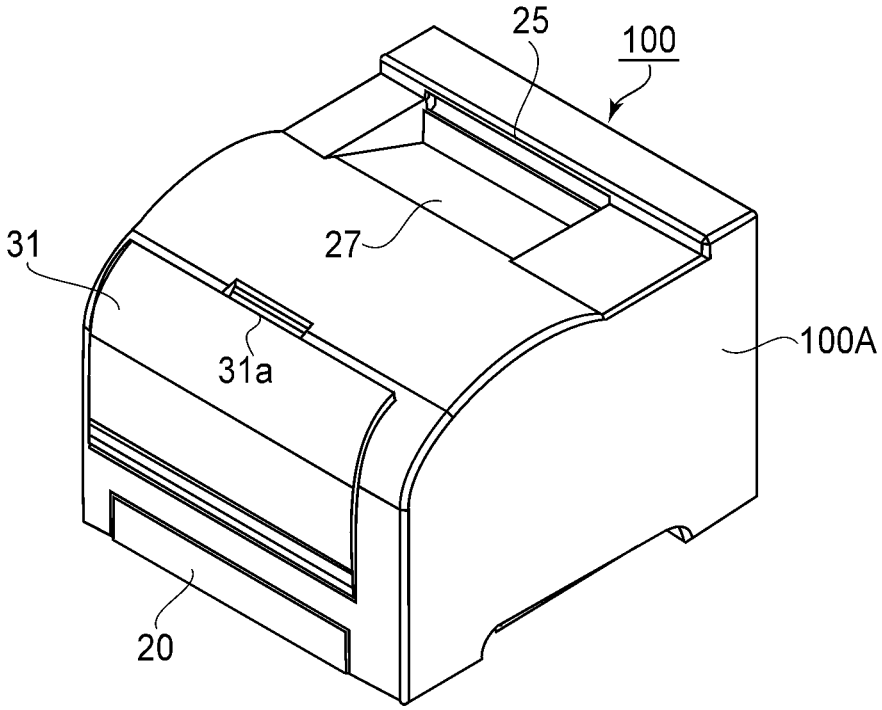
FIG. 1 is a perspective view of an outer appearance of an image forming apparatus in Embodiment 1.
Figure 2:
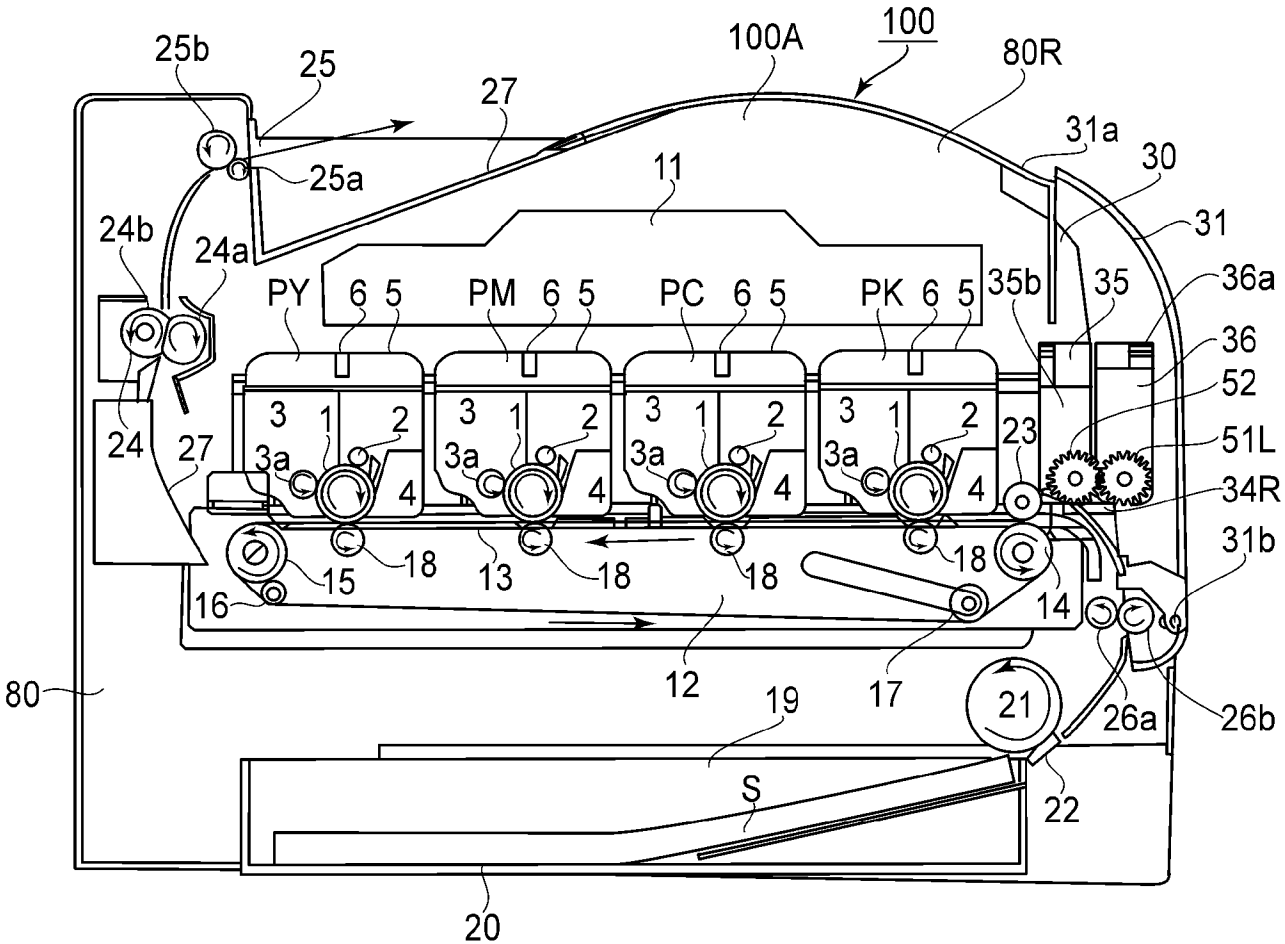
FIG. 2 is a longitudinal left side view of the image forming apparatus.

FIG. 1 is a perspective view of an outer appearance of an image forming apparatus 100 in this embodiment, and FIG. 2 is a longitudinal left side sectional view of the image forming apparatus 100. The image forming apparatus 100 is a four color-based full-color electrophotographic laser printer using an electrophotographic process. That is, the image forming apparatus 100 forms an image on a recording material (hereinafter referred to as a sheet) S on the basis of an electrical image signal input from an external host device (not shown) such as a personal computer, an image reader, or a remote facsimile machine into a control circuit portion (not shown).

In the following description, a front side (front surface side) of the image forming apparatus 100 means the side on which an apparatus opening/closing door (front door or openable door) 31 is provided. A rear side of the image forming apparatus 100 is the side opposite to the front side. A front-rear direction includes a frontward direction toward front as seen from the rear side of the image forming apparatus 100 and a rearward direction opposite to the frontward direction. The left and right sides means the left and right sides as seen from the front side of the image forming apparatus 100. A left-right direction includes a leftward direction toward left as seen from the front side and a rightward direction opposite to the leftward direction.

In an apparatus main assembly 100A of the image forming apparatus 100, four (first to fourth) process cartridges P (PY, PM, PC and PK) are horizontally arranged in the listed order in terms of the rear-to-front direction (inline or tandem arrangement). The four cartridges have the same constitution except that colors of developers (toners) accommodated therein are different from each other. Each cartridge in this embodiment includes an electrophotographic photosensitive drum 1 as an image bearing member and further includes a charging device 2, developing device 3, and a cleaning device 4 which are used as image forming process means acting on the drum 1. Further, each cartridge is prepared by integrally mounting the above-described drum 1, the charging device 2, the developing device 3, and the cleaning device 4 in a cartridge frame 5. The charging device (charging means) 2 in this embodiment is a contact charging roller. The developing device (developing means) 3 includes a developing roller 3*a* and a developer container in which the developer (toner) is accommodated. The cleaning device (cleaning means) 4 is of a blade type.

The developing device 3 of the first cartridge PY stores yellow (Y) toner. On the surface of the drum 1 of the cartridge PY, a toner (developer) image of yellow (Y) is formed. The developing device 3 of the second cartridge PM stores magenta (M) toner. On the surface of the drum 1 of the cartridge portion PM, a toner image of magenta (M) is formed. The developing device 3 of the third cartridge PC stores cyan (C) toner. On the surface of the drum 1 of the cartridge PC, a toner image of cyan (C) is formed. The developing device 3 of the fourth cartridge PK stores black (K) toner. On the surface of the drum 1 of the cartridge PK, a toner image of black (K) is formed.

In the area above the first to fourth cartridges PY, PM, PC, and PK, a laser scanner unit 11 is disposed. This scanner unit 11 outputs a beam of laser light modulated correspondingly to image (picture) information for each color input from the external host device. The output laser light enters each cartridge through an exposure window 6 provided at an upper surface of the cartridge frame 5. Thus, laser scanning exposure is performed on the surface of the drum 1.

A belt unit 12 is disposed below the cartridges PY, PM, PC, and PK. The belt unit 12 includes an endless belt 13 having flexibility, a driving roller 14, a follower roller 15, an auxiliary roller 16, and a tension roller 17 around which the belt 13 is stretched and circulatively moved. The driving roller 14 and tension roller 17 are disposed on the front side of the apparatus main assembly 100A. The follower roller 15 and the auxiliary roller 16 are disposed on the rear side of the apparatus main assembly 100A. A lower surface of the drum 1 of each cartridge P contacts an upper surface of an upper belt portion of the belt 13. Inside the belt 13, four transfer rollers 18 are disposed. Each transfer roller 18 is disposed opposite to the drum 1 of the corresponding cartridge P through the upper belt portion of the belt 13.

Below the belt unit 12, a sheet feeding unit 19 is disposed, which includes a sheet feeding tray 20, a sheet feeding roller 21, and a separation pad 22, and the like. The sheet feeding tray 20 is detachably mountable in the apparatus main assembly 100A from the front side of the image forming apparatus 100 (front loading).

At an upper portion on the rear side of the apparatus main assembly 100A, a fixing device 24 and a sheet discharging roller pair 25 are disposed. Further, at an upper surface of the apparatus main assembly 100A, a sheet discharging tray 27 is provided. The fixing device 24 includes a fixation film assembly 24*a* and a pressing roller 24*b*. The sheet discharging roller pair 25 includes sheet discharging rollers 25*a* and 25*b*.

Each cartridge P placed in a state in which it is set at a set position in the apparatus main assembly 100A is urged by an urging member (described later) to be held in a state in which each cartridge P is fixed (locked) to a predetermined positioning portion. To a drive input portion of each cartridge P, a drive output portion of the apparatus main assembly 100A is connected. Further, to electrical contacts of each cartridge P, an electric energy supplying system of the apparatus main assembly 100A is electrically connected.

An operation for forming a full-color image is as follows. With predetermined control timing, the drum 1 of each of the respective cartridges PY, PM, PC and PK is rotationally driven at the predetermined speed in the clockwise direction indicated by the arrow. Further, the belt 13 is rotationally driven in the counterclockwise direction indicated by an arrow (the (normal) rotational direction of the drum 1) at a speed which corresponds to the speed of the drum 1. The scanner unit 11 is also driven with predetermined control timing. In synchronization with the driving of the scanner unit 11, the charging roller 2 in each cartridge P uniformly electrically charges the surface of the drum 1 to predetermined polarity and potential with predetermined control timing. The scanner unit 11 scans (exposes) the surface of each drum 1 with the beam of laser light modulated correspondingly to the picture (image) signal for an associated color. As a result, an electrostatic latent image corresponding to the picture signal for the associated color is formed on the surface of the drum 1. The thus formed electrostatic latent image is developed by the developing device 3 into a toner image.

Through the above described electrophotographic image forming process operation, a yellow toner image, which corresponds to the yellow (Y) color component of a full-color image is formed on the drum 1 of the first cartridge PY. On the drum 1 of the second cartridge PM, a magenta (M) toner image, which corresponds to the magenta component of the full-color image is formed. On the drum 1 of the third cartridge PC, a cyan (C) toner image, which corresponds to the cyan component of the full-color image is formed. On the drum 1 of the fourth cartridge PK, a black (K) toner image, which corresponds to the black component of the full-color image is formed.

Meanwhile, the sheet feeding roller 21 is driven with predetermined control timing. As a result, sheets S (recording material) stacked on the sheet feeding tray 20 are separated and fed one by one by cooperation of the sheet feeding roller 21 and the separation pad 22 to be introduced into a nip between registration roller pair 26*a* and 26*b*. The sheet S is stopped in the nip between the registration roller pair 26*a* and 26*b* at its leading end to be subjected to oblique movement correction. Then, with predetermined control timing, the registration roller pair 26*a* and 26*b* is driven, so that the sheet S is sent to a nip between the belt 13 and an electrode roller 23 disposed oppositely to the driving roller 14 of the belt unit 12 with respect to the belt 13. The sheet S is electrostatically held on the surface of the upper-side belt portion of the belt 13 and is conveyed from the front side to the rear side in the apparatus main assembly 100A. That is, the sheet S is conveyed while successively passing through positions (transfer portions) of respective transfer rollers 18 of the fourth cartridge PY, the third cartridge PC, the second cartridge PM, and the first cartridge PY. As a result, onto the surface of the sheet S, the black (K) toner image, a the cyan (C) toner image, the magenta (M) toner image, and the yellow (Y) toner image are successively transferred in a predetermined superposition manner. Thus, on the surface of the sheet S conveyed by the belt 13, unfixed full-color toner image of four colors of K, C, M and Y are synthetically formed.

In each cartridge P, untransferred toner remaining on the drum 1 surface after the transfer of the toner images onto the sheet S is removed by the cleaning device 4.

The sheet S having passed through the transfer portion of the last cartridge (first cartridge) PY is separated from the surface of the belt 13 at a position of the follower roller 15 and is then guided by a guide 27 to be introduced into the fixing device 24. The sheet S is subjected to heat and pressure in a fixation nip of the fixing device 24. As a result, color mixing of the respective color toner images and fixation thereof on the sheet S are performed. Thereafter, the sheet S is moved out of the fixing device 24, and then is discharged as a full-color image formation product onto the sheet discharge tray 27 by a sheet discharge roller pair 25.

(Cartridge Exchange)

As each cartridge (PY, PM, PC, PK) is used for image formation, the developer (toner) stored in the developing device 3 is consumed. Then, when the developer is consumed to such an extent that an image of a quality satisfactory to a user who has purchased the cartridge cannot be formed, the exchange of the cartridge 3 is required.

For this reason, e.g., the image forming apparatus is provided with a means (not shown) for detecting an amount of the developer remaining in each cartridge. The detected amount of the developer in each cartridge is compared, by the control circuit portion, with a threshold value preset for providing a prewarning or warning of the lifetime of the cartridge. When the detected amount of the residual developer in the cartridge is smaller than the preset threshold value, the prewarning or warning of the lifetime of the cartridge is displayed on a display portion (not shown). As a result, the image forming apparatus prompts the user to prepare a cartridge for exchange, or to replace the cartridge with a fresh cartridge, in order to maintain an output image quality.

In this embodiment, the exchange (replacement) of the cartridge with respect to the image forming apparatus is performed through a method in which the cartridge P is placed on a cartridge tray 35 as a pull-out type frame-like movable member and is replaced in a front-access manner in order to improve usability.

On the front side of the apparatus main assembly 100A, an opening 30 through which the tray 35 (cartridge P) passes when the cartridge P is pushed in the inside of the apparatus main assembly 100A or is pulled out from the apparatus main assembly 100A is provided.

Further, on the front side of the apparatus main assembly 100A, a rotatable and openable door 31 is provided. This door 31 is an openable member locatable at a closed position in which the opening 30 is covered with the door 31 and at an open position in which the opening 30 is exposed.

Figure 3:
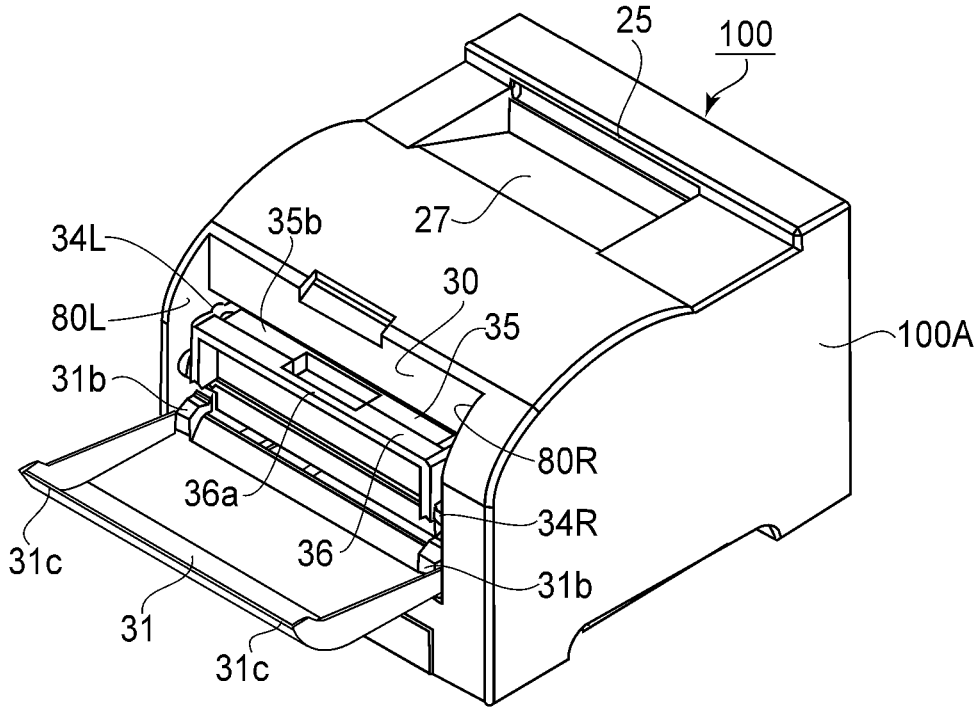
FIG. 3 is a perspective view of an outer appearance of the image forming apparatus in a state in which a front door is opened.

In this embodiment, the door 31 can be opened and closed and can be rotationally moved relative to the apparatus main assembly 100A about a hinge position 31*b* provided at a lower portion of the door 31. That is, the door 31 is rotated about the hinge portion 31*b* so that it can be moved into the closed position (roughly vertical position) to place the opening 30 in a closed state as shown in FIGS. 1 and 2, and also, so that it can be rotated frontward about the hinge portion 31*b* into the open position (roughly horizontal position), as shown in FIG. 3, to place the opening 30 in an opened state. To the door 31, a holding portion (finger placement portion) 31*a* for opening/closing the door 31 is provided.

The door 31 is also opened during maintenance for jam clearance or the like in addition to the cartridge exchange specifically described later. After the jam clearance, when the door 31 is closed, the cartridge is still urged against the apparatus main assembly by the urging member. Therefore, there is no need to adjust (correct) color misregistration.

Inside left and right frames 80L and 80R of a main frame 80 of the apparatus main assembly 100A, a pair of left and right tray holding members (movable means or rail members) 34L and 34R is disposed, respectively. These tray holding members 34L and 34R oppose each other. A longitudinal (lengthwise) direction of each of the tray holding members 34L and 34R coincides with the front-rear direction of the apparatus main assembly 100A. Between the left and right tray holding members 34L and 34R, the tray 35 is held horizontally slidably in the front-rear direction of the apparatus main assembly 100A. The tray 35 supports each cartridge P. That is, the tray 35 includes mounting portions to which the plurality of cartridges PY, PM, PC and PK are detachably mountable.

Figure 4:
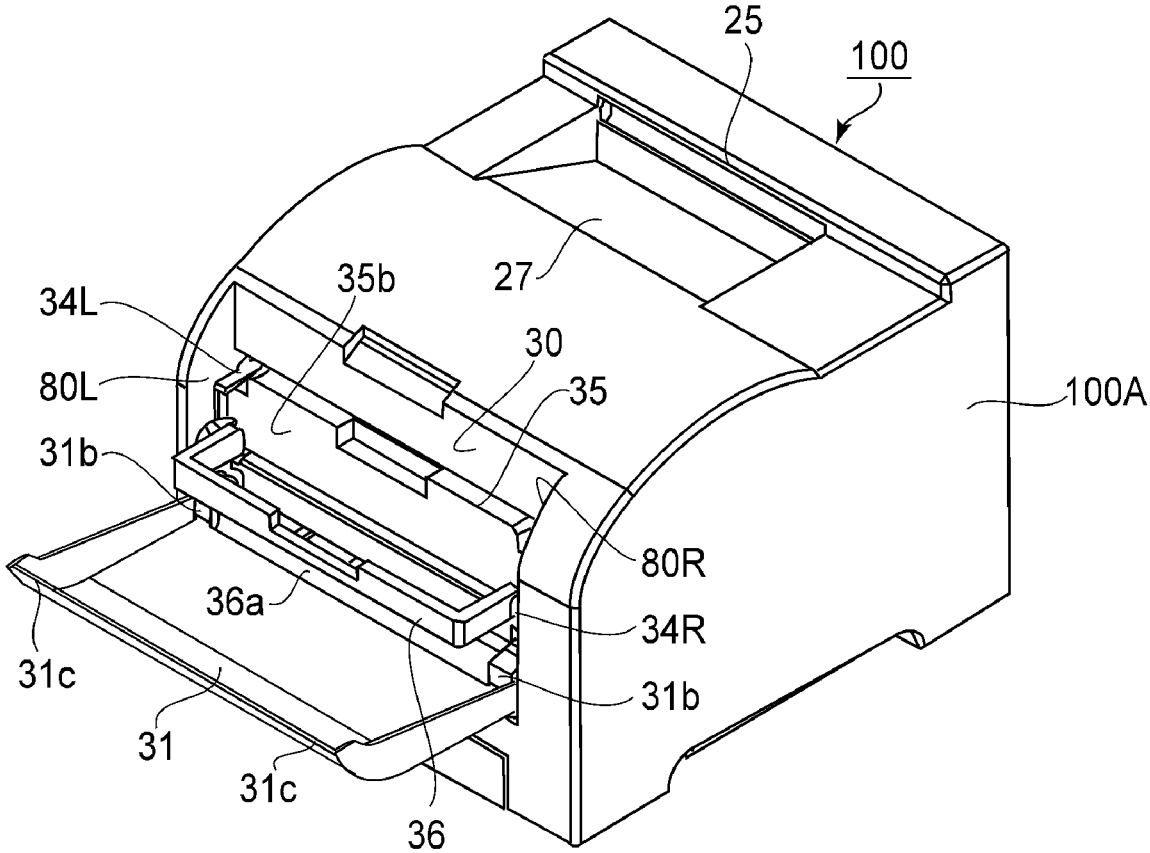
FIG. 4 is a perspective view of an outer appearance of the image forming apparatus in a state in which the front door is opened and then a grip member of a tray is rotated forward to be placed in an opened state.
Figure 5:
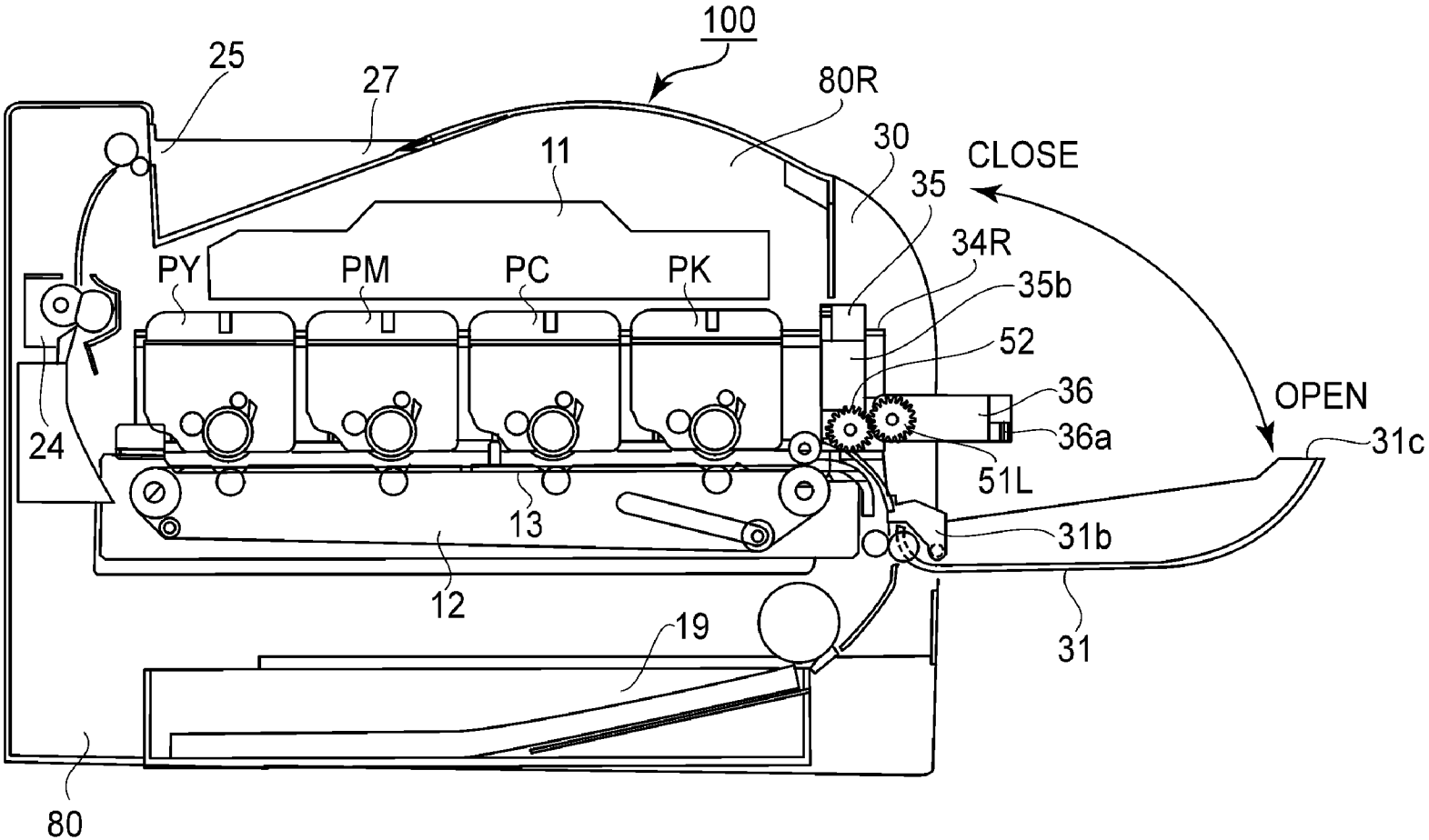
FIG. 5 is a longitudinal left side view of the image forming apparatus shown in FIG. 4.

To a front frame 35*b* of the tray 35, a grip member 36 which is shaft-supported rotatably and is capable of being rotated forward (forward rotation) and rotated backward (backward rotation) is provided. In this embodiment, the grip member 36 can be rotated about a shaft-supporting portion to be placed in a closed state (a reference position) in which the grip member 36 is erected substantially vertically to face (contact) the front surface of the front frame portion of the tray 35 as shown in FIGS. 2 and 3. Further, the grip member 36 can be rotated about the shaft-supporting portion to be placed in an opened state (an outward position) in which the grip member is tilted forward substantially horizontally from the front surface of the front frame 35*b* of the tray 35 as shown in FIGS. 4 and 5. In this embodiment, the forward rotation of the grip member 36 means an operation for rotating the grip member 36 substantially 90 degrees from the above-described closed state to the above-described opened state (forward rotation with a predetermined rotation angle). On the other hand, the backward rotation of the grip member 36 means an operation for rotating the grip member substantially 90 degrees from the opened state to the closed state (backward rotation with a predetermined rotation angle).

An operation for exchanging the cartridge is as follows. The door 31 which covers the opening 30 of the apparatus main assembly 100A as shown in FIGS. 1 and 2 is opened as shown in FIG. 3. As a result, the opening 30 is exposed considerably, so that the front frame 35*b* of the tray 35 is also exposed. At this time, the grip member 36 located on the front side of the front frame 35*b* is in the closed state. The user grips a grip portion 36*a* of the grip member 36 and rotates 90 degrees forward the grip member 36, thus placing the grip member 36 in the opened state in which the grip member 36 is substantially horizontally located. In this case, by an interrelating mechanism described later operating in interrelation with the forward rotation of the grip member 36, the tray holding members 34L and 34R are moved by a predetermined distance. That is, the tray holding members 34L and 34R are moved from a first position to a second position. Here, the first position is a position of the tray holding members 34L and 34R in which the tray 35 (cartridge P) is moved to a transfer contact position (inside position) shown in FIG. 2, and the second position is a position of the tray holding members 34L and 34R in which the tray 35 is moved between a pushed-in position (FIG. 5) and a pulled-out position (FIGS. 6 and 7) with respect to the apparatus main assembly 100A. The pushed-in position is a position in which the tray 35 is pushed in the inside of the apparatus main assembly 100A until the tray 35 runs against and is stopped by a stopper portion (not shown) provided to the tray holding members 34L and 34R. The pulled-out position is a position in which the tray 35 is pulled out to the outside of the apparatus main assembly 100A and each cartridge P is detachably mountable to the above-described mounting portion.

In interrelation with the upward movement of the tray holding members 34L and 34R, drive output portions on the apparatus main assembly side are disengaged from corresponding drive input portions of each of the cartridges PY, PM, PC and PK (driven portion disengagement). Further, the urging by the urging member which positions and fixes (locks) each cartridge with respect to the positioning portion of the apparatus main assembly 100A is released (urging release or locking release). Further, electrical conduction of the electric energy supplying system on the apparatus main assembly 100A side to the electrical contacts of each cartridge is ceased (electrical disconnection). Further, the positioning of the tray 35 with respect to the apparatus main assembly 100A is released. These are also described specifically later.

As described above, when the tray holding members 34L and 34R are moved from the first position to the second position, the tray 35 and each cartridge P are also moved upward together with the tray holding members 34L and 34R, so that the drum 1 is separated from the belt 13 (FIG. 5). That is, the tray 35 is moved from the transfer contact position (inside position shown in FIG. 2) in which the drum 1 and the belt 13 contact each other to the transfer separation position (pushed-in position) (FIG. 5) in which the drum 1 and the belt 13 are separated from each other.

Figure 6:
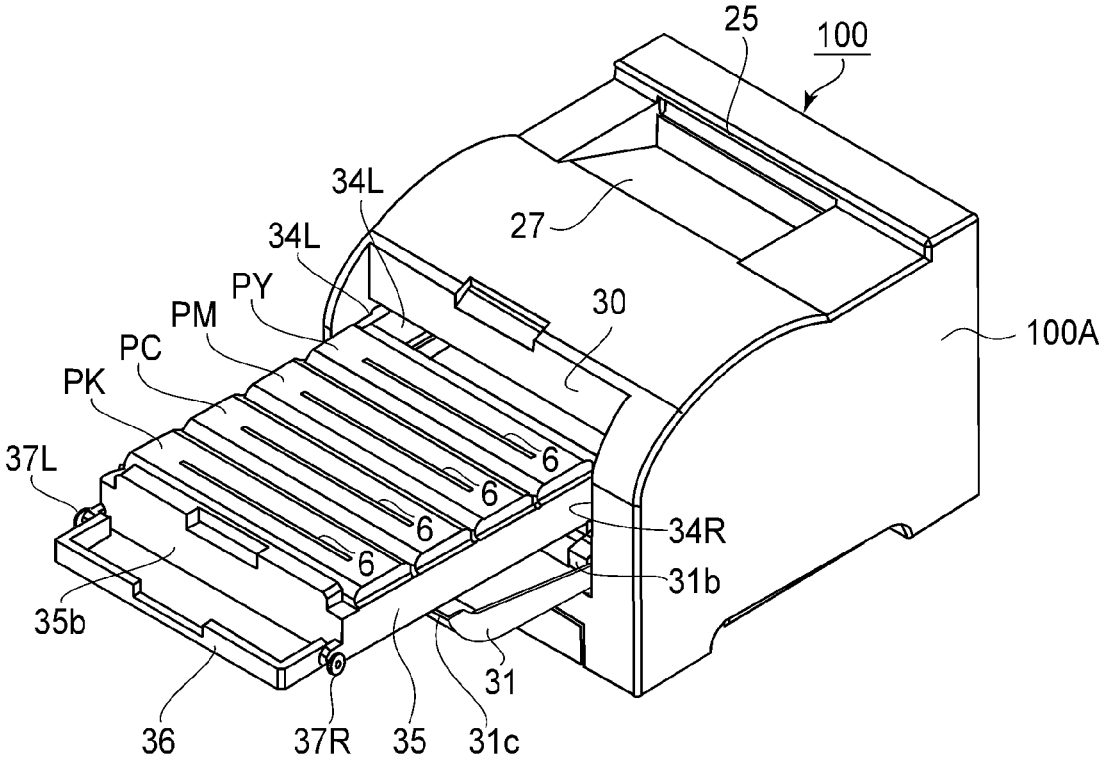
FIG. 6 is a perspective view of an outer appearance of the image forming apparatus in a state in which the tray is pulled out from the state shown in FIG. 4.
Figure 7:
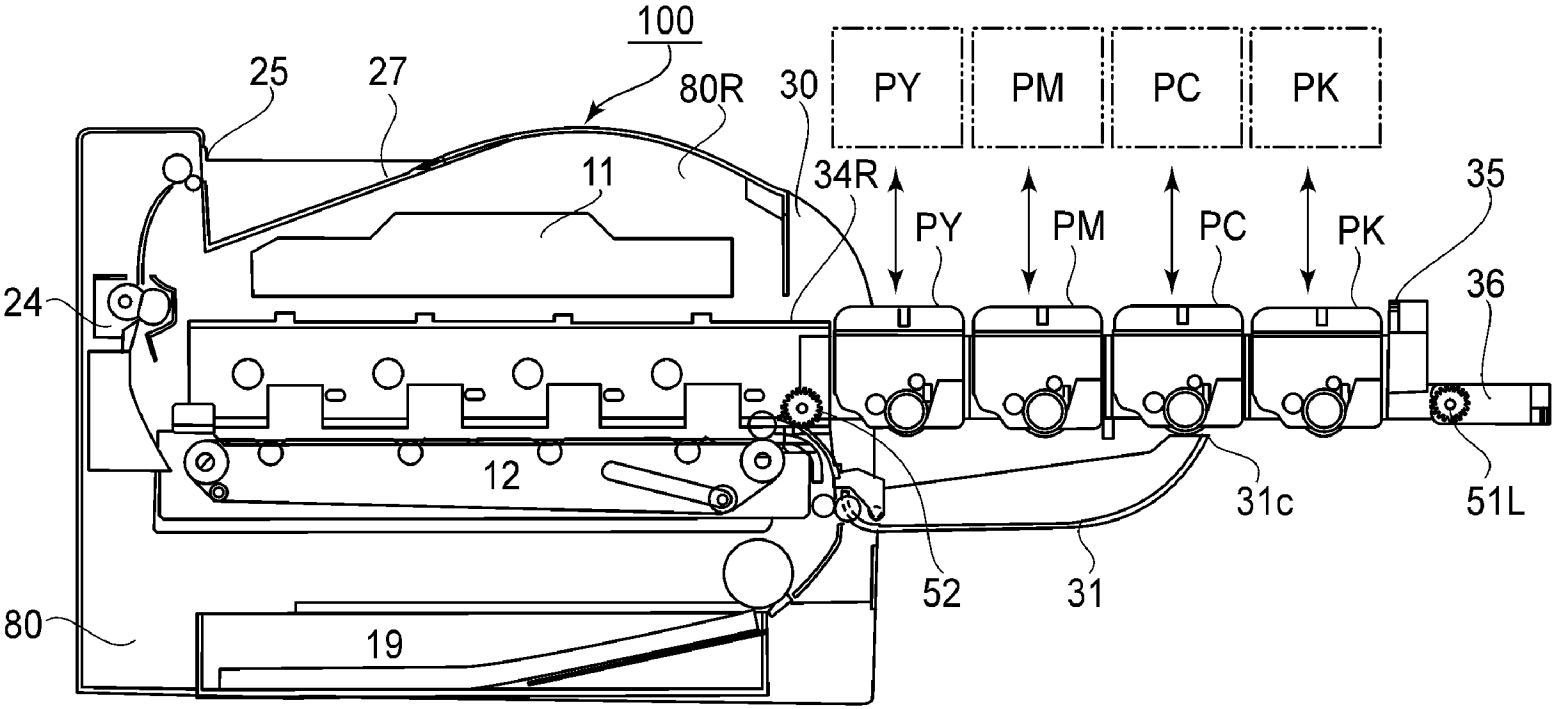
FIG. 7 is a longitudinal left side view the image forming apparatus shown in FIG. 6.

Then, the grip member 36 placed in the opened state is gripped and the tray 35 is slid along the tray holding members 34L and 34R so as to be pulled out, thus being slidably moved horizontally and frontward. Then, as shown in FIGS. 6 and 7, the tray 35 is sufficiently pulled out through the opening 30 to a predetermined pulled-out position located outside the apparatus main assembly 100A.

In this pull-out movement of the tray 35, the drum 1 of each cartridge P and the belt 13 are separated from each other, so that friction therebetween is not caused to occur.

As a result, the entire first to fourth (four) cartridges PY, PM, PC and PK held by the tray 35 pass through the opening 30 to be exposed to the outside of the apparatus main assembly 100A, so that the upper surfaces of all the cartridges are exposed. When the tray 35 is pulled out with a predetermined sufficient distance, further pull-out movement of the tray 35 is prevented by a stopper portion (not shown). Further, the tray 35 is held, in the state in which it is horizontally pulled out to the predetermined pulled-out position, by the tray holding members 34L and 34R. At this time, the tray 35 located at the considerably pulled-out position from the apparatus main assembly 100A can be supported by the supporting portion 31*a* of the door 31 as shown in FIGS. 6 and 7. As a result, it is possible to prevent damage of the drum surface by considerably downward bending of the tray 35 on the main assembly front side due to the weight of the tray 35 and the cartridges and to prevent the apparatus main assembly 100A from toppling over forward due to off-balance weight of the apparatus main assembly 100A by the pulling out of the tray 35. The door 31 is rotationally moved, the door 31 can be provided so that the supporting portion 31*a* is located inside the apparatus main assembly during the door closing and is located outside the apparatus main assembly during the door opening. Therefore, the tray 35 can be stably held at the pulled-out position to improve usability during the cartridge exchange without increasing the size of the apparatus main assembly.

The tray 35 supports each cartridge P so as to be detachably movable directly above. The tray 35 supports each cartridge P by moving each cartridge P directly below. As shown by chain double-dashed lines in FIG. 7, a spent cartridge P to be replaced is raised and removed above from the tray 35. Then, a fresh cartridge is engaged in and placed on the tray from above.

In the case where the cartridge having an openable drum cover (not shown) for protecting the lower surface of the drum 1, the cover is manually closed after the cartridge is demounted from the tray 35. Further, with respect to a fresh cartridge, the cover is manually opened before the fresh cartridge is placed on the tray 35. In another embodiment, in the process in which the cartridge is demounted by upwardly raising the cartridge from the tray 35, the cover is automatically closed. Further, in the process in which the cartridge is engaged in and placed on the tray 35 from above, the cover is automatically opened.

As shown in FIGS. 6 and 7, when the tray 35 is pulled out to the pulled-out position and then a cartridge, to be exchanged, of the cartridges held on the tray 35 is exchanged, the user sufficiently pushes and moves the tray 35 into the apparatus main assembly to be accommodated at the pushed-in position. That is, the tray 35 is returned to the state before the pulling out as shown in FIGS. 4 and 5. Also during the push-in movement of the tray 35, the drum 1 of each cartridge P and the belt 13 are separated from each other, so that friction therebetween is not caused to occur.

After the tray 35 is sufficiently pushed in to the pushed-in position, the grip member 36 is rotated backward from the opened state of FIG. 4 to be returned to the closed state of FIG. 3. By the interrelating mechanism operating in interrelation with the backward rotation of the grip member 36, the tray holding members 34L and 34R are moved downwardly by a predetermined distance. That is, the tray holding members 34L and 34R are moved from the second position to the first position. When the tray holding members 34L and 34R are moved from the second position to the first position, the tray and each cartridge P are also moved downwardly together with the tray holding members 34L and 34R, so that the drum 1 contacts the belt 13 (FIG. 2). That is, the tray 35 is moved from the transfer separation position (pushed-in position) (FIG. 5) in which the drum 1 and the belt 13 are separated from each other to the transfer contact position (FIG. 2: inside position) in which the drum 1 and the belt 13 are brought into contact with each other.

Further, in interrelation with the downward movement of the tray holding members 34L and 34R, each cartridge is urged by the urging member to be held in the state in which the cartridge is fixed (locked) to the predetermined positioning portion. To the drive input portion of the cartridge, the drive output portion on the apparatus main assembly side is connected. To the electrical contacts of the cartridge, the electric energy supplying system on the apparatus main assembly side is electrically connected. Further, the tray 35 is positioned to the apparatus main assembly 100A by the tray movement preventing means.

Finally, the opened door 31 is closed as shown in FIGS. 1 and 2 to complete the cartridge exchanging operation.

(Cartridge P)

Figure 8:
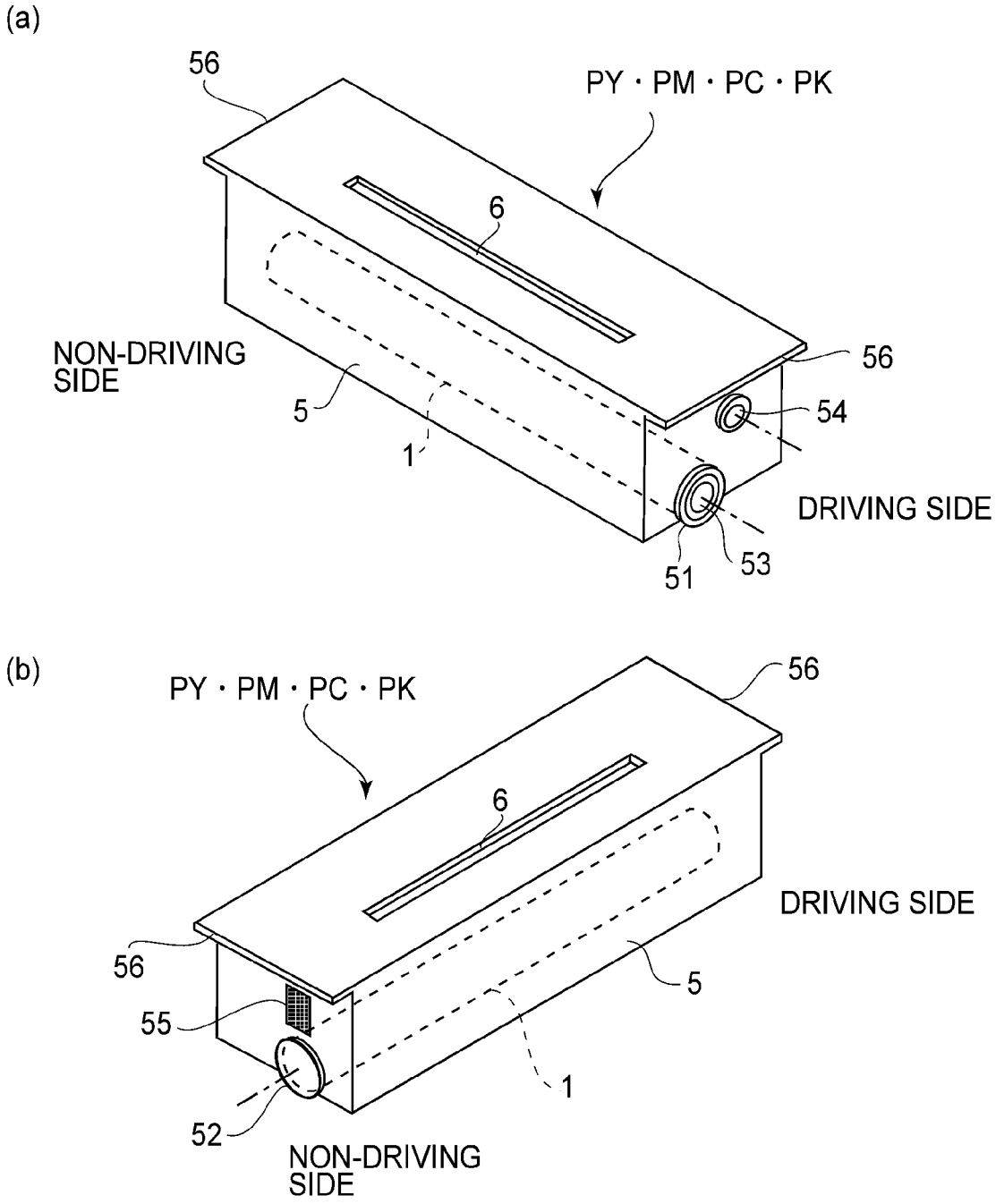
FIG. 8(*a*) is an outer appearance perspective view of a cartridge as seen from a driving side and FIG. 8(*b*) is an outer appearance perspective view of the cartridge as seen from a non-driving side.

FIG. 8(*a*) is a perspective view of the cartridge P as seen from the driving side and FIG. 4 is a perspective view of the cartridge P as seen from the non-driving side.

The cartridge P is an elongated box-type assembly extending in the axial direction of the drum 1 as the left-right direction (longitudinal direction). The drum 1 is rotatably supported between shaft supporting portions 51 and 52 provided at left and right side surface portions of the cartridge frame 5. To the right shaft supporting portion 51, a coupling engaging portion 53 as the drum drive force input portion is provided. To the right side surface portion of the cartridge frame 5, a coupling engaging portion 54 as the developing device drive input portion for driving the developing roller 3*a* is provided. To the left side surface portion of the cartridge frame 5, a cartridge electrical contact 55 is provided. At upper portions of the left and right side surface portions of the cartridge frame 5, eaves 56 are provided by extending and projecting the upper surface portion of the cartridge frame 5 in the left-right direction. With respect to the cartridge, the right side surface portion side provided with the coupling engaging portions 53 and 54 is the driving side and the left side surface portion side opposite from the right side surface portion side is the non-driving side.

(Tray 35)

The tray 35 is a movable member provided movably in a direction intersecting the axial direction of the drum 1 of each cartridge. Further, the tray 35 is movable between the pulled-out position in which the tray 35 having passed through the opening 30 is located outside the apparatus main assembly and each cartridge is mountable to and demountable from the apparatus main assembly and a latent image forming position (inside position) in which the electrostatic latent image can be formed on the drum 1.

Figure 9:
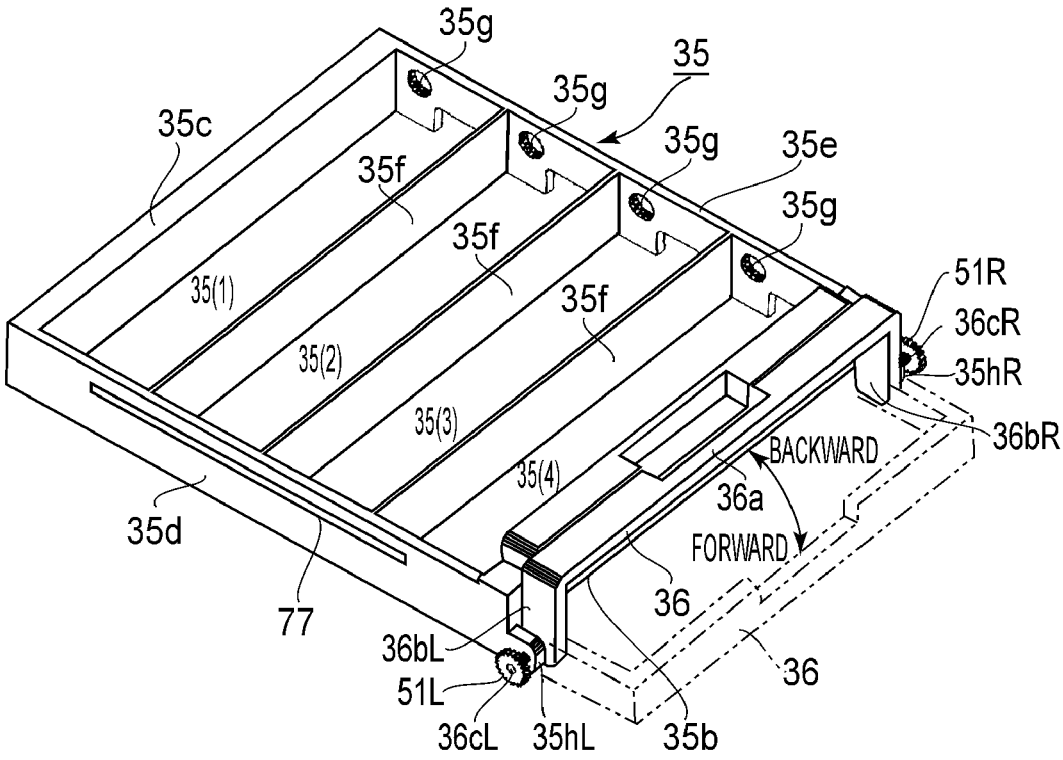
FIG. 9 is an outer appearance perspective view of the tray.

FIG. 9 is a perspective view of an outer appearance of the tray 35.

The tray 35 includes a rectangular main frame portion prepared by connecting a front frame 35*b*, a rear frame 35*c*, a left frame 35*d*, and a right frame 35*e*. The inside of the main frame portion is substantially equally partitioned into four areas by three partitioning plates 35*f* with respect to the front-rear direction of the main frame portion, so that first to fourth elongated small frame portions 35(1) to 35(4) from the rear frame 35*c* side to the front frame 35*b* side are formed in this order in parallel to each other. The small frame portions 35(1), 35(2), 35(3) and 35(4) are mounting portions to which the first to fourth cartridges PY, PM, PC and PK are held, respectively. With respect to each of the small frame portions 35(1) to 35(4), the right frame 35*e* is provided with a hole 35*g* though which a developing device driving coupling passes.

Further, the tray 35 includes an intermediary electric contact 77 to be electrically connected to the electric contact 55 (FIG. 8) of each cartridge. The intermediary electric contact 77 is electrically connectable to a main assembly side electric contact (not shown) provided to the apparatus main assembly 100A.

Each of the cartridges PY, PM, PC and PK is inserted from above into an associated small frame portion of the tray 35. Then, lower surfaces of the left and right eaves 56 are stopped by the upper surfaces 61*a* of the left and right frames 35*d* and 35*e*, so that each cartridge (PY, PM, PC or PK) is accommodated in and supported by the tray 35. That is, the tray 35 supports each cartridge demountably right above and supports each cartridge by moving each cartridge right below. The tray 35 roughly supports each of the cartridges. As a result, it is possible to easily perform exchange of each cartridge.

The grip member 36 is an elongated portal-shaped member extending in the left-right direction and is shaft-supported rotatably between shaft supporting portions 34*h*L and 34*h*R provided to front-side left and right side end portions of the front frame 35*b* of the tray 35. That is, a left side leg portion 36*b*L of the grip member 36 is located inside the left shaft supporting portion 35*h*L which is provided with a shaft supporting hole. Into the shaft supporting hole, a shaft portion 36*c*L which is provided integrally with the left side leg portion and extends in the left-right direction is inserted. The shaft portion 36*c*L is projected outwardly from the left shaft supporting portion 35*h*L and with the projected shaft portion 36*c*L, a first left spur gear 51L is integrally engaged. Further, a right side leg portion 36*b*R of the grip member 36 is located inside the right shaft supporting portion 35*h*R which is provided with a shaft supporting hole. Into the shaft supporting hole, a shaft portion 36*c*R which is provided integrally with the right side leg portion and extends in the left-right direction is inserted. The shaft portion 36*c*R is projected outwardly from the right shaft supporting portion 35*h*R and with the projected shaft portion 36*c*R, a first right spur gear 51R is integrally engaged. As a result, the grip member 36 can be placed in the closed state as indicated by a solid line by being rotated backward about the shaft supporting portions to face (contact) the front surface of the front frame 35*b* of the tray 35. Further, the grip member 36 can be placed in the opened state as indicated by a chain double-dashed line by being rotated forward from the front frame 35*b* about the shaft supporting portions. The first left spur gear 51L and the first right spur gear 51R are rotated forward together by the forward rotation of the grip member 36 and are rotated backward together by the backward rotation of the grip member 36.

(Tray Holding Members 34L and 34R)

The left and right tray holding members 34L and 34R are movable means for moving the tray 35 from the latent image forming position (image forming position) to the set position in the upward direction before the tray 35 as the movable member is moved to the pulled-out position in which each cartridge is detachably mountable. Alternatively, the left and right tray holding members 34L and 34R are movable means for moving the tray 35 from the set position to the latent image forming position in the downward direction. In other words, the tray holding members 34L and 34R are a supporting member for supporting the tray 35 and can take the second position for permitting movement of the tray 35 between the pulled-out position and the set position and can take the first position for permitting positioning of the tray 35 at the latent image forming position. Further, by the interrelating mechanism operating in interrelation with the forward rotation of the grip member 36, the tray holding members 34L and 34R are moved from the first position to the second position. The tray holding members 34L and 34R are moved from the second position to the first position by the interrelating mechanism operating in interrelation with the backward rotation of the grip member 36.

Figure 10:
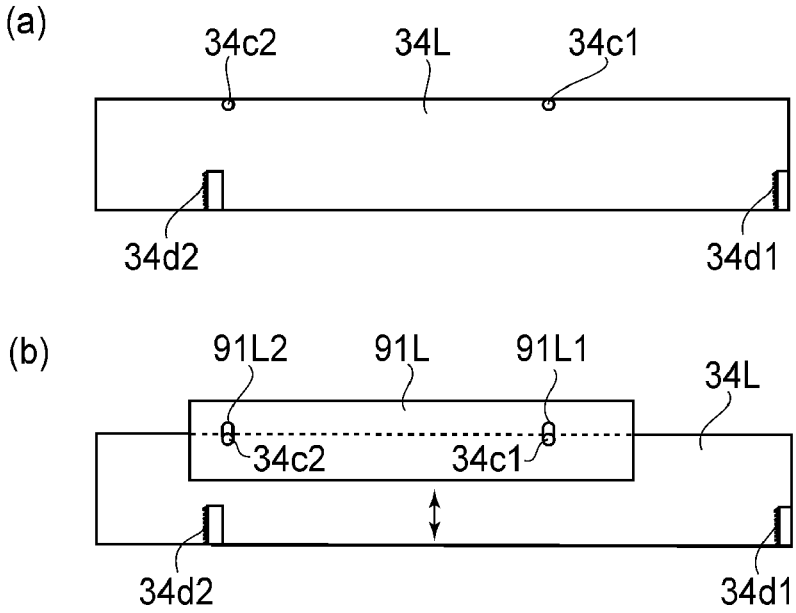
FIGS. 10(*a*) and 10(*b*) are schematic views for illustrating an outer surface portion of a left side tray holding member.

FIG. 10(*a*) is an outer surface view of the left side tray holding member 34L. On the other surface side of the tray holding member 34L, two pins 34*c*1 and 34*c*2 are provided at front and rear portions with a spacing with respect to the front-rear direction. Further, two vertical racks 34*d*1 and 34*d*2 are provided at front and rear portions with spacing. The pins 34*c*1 and 34*c*2 of the left tray holding member 34L are, as shown in FIG. 10(*b*), engaged with elongated vertical guide holes 91L1 and 91L2 provided at front and rear portions of a stationary member 91L provided integrally with a left frame 80L of a main frame of the apparatus main assembly. By the engagement between the pin 34*c*1 and the guide hole 91L1 and the engagement between the pin 34*c*2 and the guide hole 91L2, the tray holding member 34L is supported vertically movably within a range of a hole length of each of the guide holes 91L1 and 91L2 with respect to the stationary member 91L.

The right side tray holding member 34R is not shown but has the same constitution as that of the left side tray holding member 34L described above. That is, the right side tray holding member 34R is also provided with front and rear pins and front and rear racks in an asymmetrical manner with respect to those of the left side tray holding member 34L. The front and rear pins are engaged with elongated vertical guide holes provided at front and rear portions of a stationary member provided integrally with a right frame 80R of the apparatus main assembly main frame. By the engagement between the pins and associated guide holes, the right side tray holding member 34R is also supported vertically movably within a range of a hole length of each of the guide holes with respect to the stationary member.

That is, each of the left and right tray holding members 34L and 34R has latitude in vertical movement with the guide ranges of the associated guide holes with respect to the associated stationary member provided integrally with the left or right tray holding member 34L or 34R.

(Interrelating Mechanism Between Grip Member 36 and Tray Holding Members 34L and 34R)

The interrelating mechanism between the grip member 36 and the left tray holding member 34L and the interrelating mechanism between the grip member 36 and the right tray holding member 34R are symmetrically provided to the left tray holding member 34L and the right tray holding member 34R, respectively, and similarly function and operate. Therefore, with reference to FIGS. 11 to 14, the interrelating mechanism on the left tray holding member 34L side will be described and thus the interrelating mechanism on the right tray holding member 34L side will be omitted from illustration and description.

To a stationary member (not shown) on the left frame 80L side of the apparatus main assembly main frame, a shaft 55 is rotatably provided through a shaft supporting member (not shown) with respect to the front-rear direction as an axial direction thereof. To front and rear ends of the shaft 55, a second level bevel gear 54 and a third bevel gear 56 are fixed, respectively. On the second bevel gear 54 side, to a member (not shown) on the left frame 80L side, a first bevel gear 53 and a second spur gear 52 and rotatably provided as a two-stepped gear through a shaft supporting member (not shown). The first bevel gear 53 engages with the second bevel gear 54. The second spur gear 52 engages with the front rack 34*d*1 of the tray holding member 34L. On the third bevel gear 56 side, to a stationary member (not shown) on the left frame 80L side, a fourth bevel gear 57 and a third spur gear 58 are rotatably provided as a two-stepped gear through a shaft supporting member (not shown). The fourth bevel gear 57 engages with the third bevel gear 56. The third spur gear 58 engages with the rear rack 34*d*1 of the tray holding member 34L. To a rear end of the third bevel gear 56, a bifurcated member 59 is fixed coaxially with the third bevel gear 56. In the neighborhood of the bifurcated member 59, an L-shaped stopper member 60 engageable with the bifurcated member 59. The stopper member 60 is rotatably provided about a vertical shaft 60*a* with respect to the stationary member (not shown) on the left frame 80L side. The stopper member 60 is rotationally urged by a tension spring 61 so that one arm portion 60*b* of the L-shaped stopper member 60 is moved toward the bifurcated member 59. A reference numeral 60*c* represents the other arm portion of the L-shaped stopper member 60.

Figure 11:
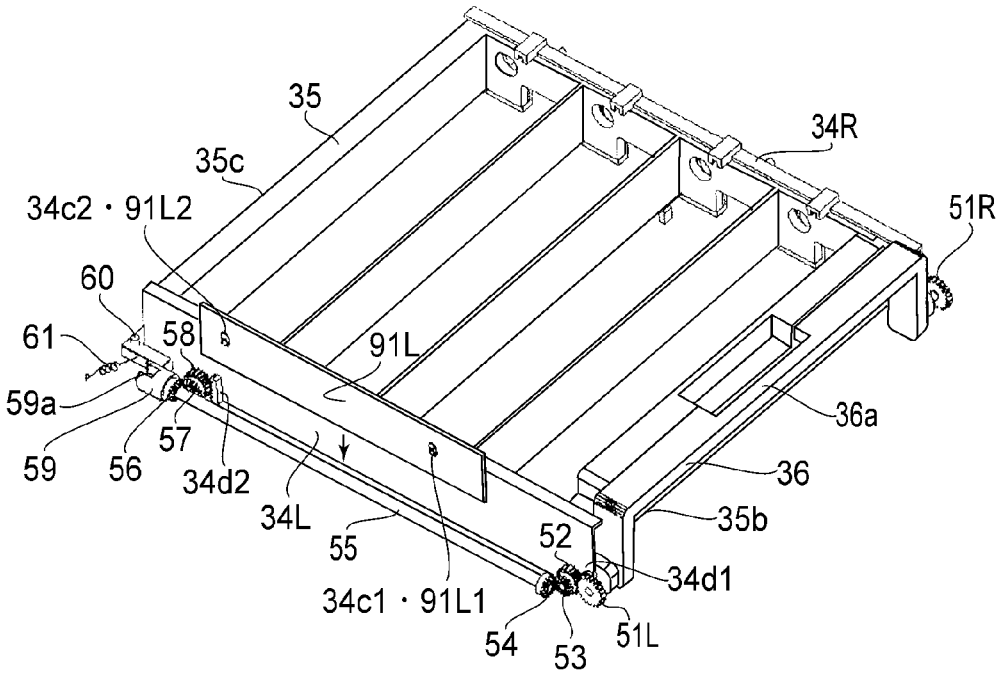
FIG. 11 is an outer appearance perspective view of left and right tray holding members, a left side interrelating mechanism, and the tray place in a state in which the grip member is in a closed state.
Figure 14:
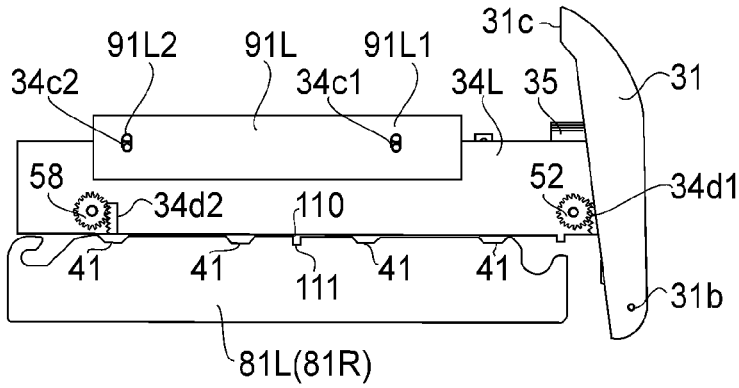
FIGS. 14(*a*), 14(*b*) and 14(*c*) are schematic views each for illustrating movement of the tray holding member in interrelation with rotational movement of the grip member.
Figure 14:
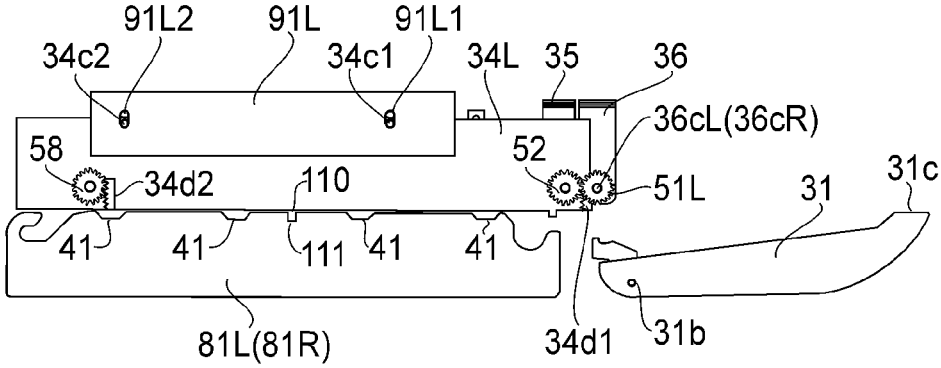
Figure 14:
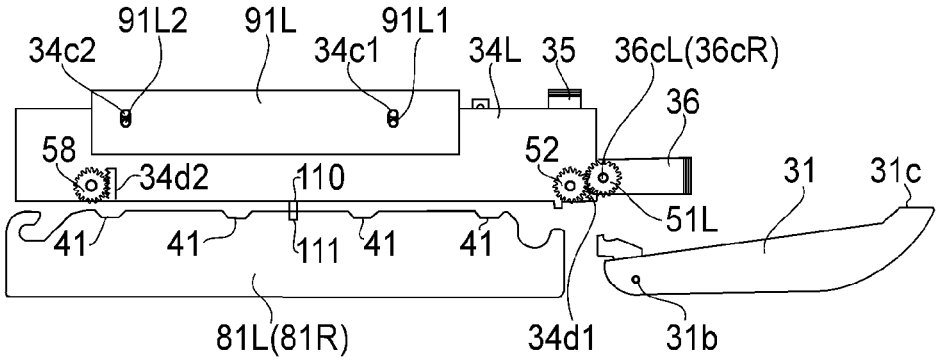

FIG. 11 and FIG. 14(*a*) show a state in which the tray 35 is moved to the pushed-in position inside the apparatus main assembly and the grip member 36 and the door 31 are closed as shown in FIG. 2. In this state, the left and right tray holding members 34L and 34R are moved through the interrelating mechanism in the downward direction within the apparatus main assembly. The pins 34*c*1 and 34*c*2 are located at lower portions of the guide holes 91L1 and 91L2. The right tray holding member 34R is configured similarly as in the left tray holding member. For that reason, each of the left and right tray holding members 34L and 34R are held at a predetermined lower portion (the first position) with respect to the stationary member 91L (91R: not shown) of the left frame 80L (or the right frame 80R). Therefore, the tray 35 held by the tray holding members 34L and 34R is also held at a predetermined lower position (the latent image forming position).

Each of the cartridges PY, PM, PC and PK held by the tray 35 is urged by the urging member at each of the left and right upper surface portions thereof. As a result, lower surface portions (portions to be positioned) of the driving-side shaft supporting portion 51 and the non-driving-side shaft supporting portion 52 are fixed to positioning portions 41 provided to stay members (inner side plates) 81L and 81R of the apparatus main assembly 100A, so that each cartridge is held in a predetermined positioning state with respect to the apparatus main assembly 100A. In this state, the lower surface of the drum of each cartridge stably contacts the upper surface of the upper-side belt portion of the belt unit 12.

The coupling engaging portions 53 and 54 of each cartridge are placed in a state in which the drum driving coupling and the developing device driving coupling which are provided on the apparatus main assembly side are engaged therein, respectively.

To the electric contact 55 of each cartridge, electric power can be supplied from the apparatus main assembly through the intermediary electric contact.

Figure 15:
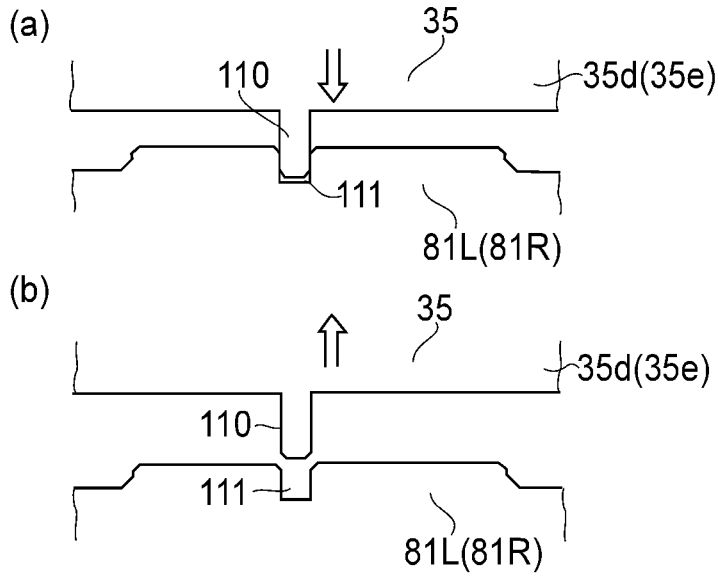
FIGS. 15(*a*) and 15(*b*) are schematic views for illustrating a tray movement preventing means (a pin and a U-shaped groove portion).

Further, the tray 35 is positioned to the stay member 81 of the apparatus main assembly by a tray movement preventing means. In this embodiment, the positioning of the tray 35 is performed by the tray movement preventing means described below. That is, as shown in FIGS. 15(*a*) and 15(*b*), a downward pin 110 is provided to either one or both of the left and right frames 35*d* and 35*e* of the tray 35. Further, a U-shaped groove 111 is provided to either one or both of the left and right stay members 81L and 81R of the apparatus main assembly. In the state in which the tray 35 is moved to the transfer contact position, the downward pin 110 engages with the U-shaped groove 111 as shown in FIG. 15(*a*), so that movement of the tray 35 in the front-rear direction is prevented and thus the tray 35 is positioned to the apparatus main assembly 100A.

A first left spur gear 51L and a first right spur gear 51R of the tray 35 are engaged with the second spur gear 52 (FIG. 11) of the left side interrelating mechanism and the second spur gear of the right side interrelating mechanism (not shown). The other arm portion 60*c* of the stopper member 60 of each of the left and right interrelating mechanisms is urged rearward at the rear end surface of the rear frame 35*c* of the tray 35 located at the pushed-in position. As a result, each of the stopper portions 60 of the left and right interrelating mechanisms is held in a rotation angle state (disengaged state) in which one arm portion 60*b* is escaped from the bifurcated member 59 against a pulling force of the spring 61 with the vertical shaft 60*a* as a center. Further, each of the shafts of the left and right interrelating mechanisms is in such a rotation angle state that a bifurcated portion 59*a* of the bifurcated member 59 is vertically directed.

The image forming apparatus can perform an image forming operation in the above-described state.

Figure 13:
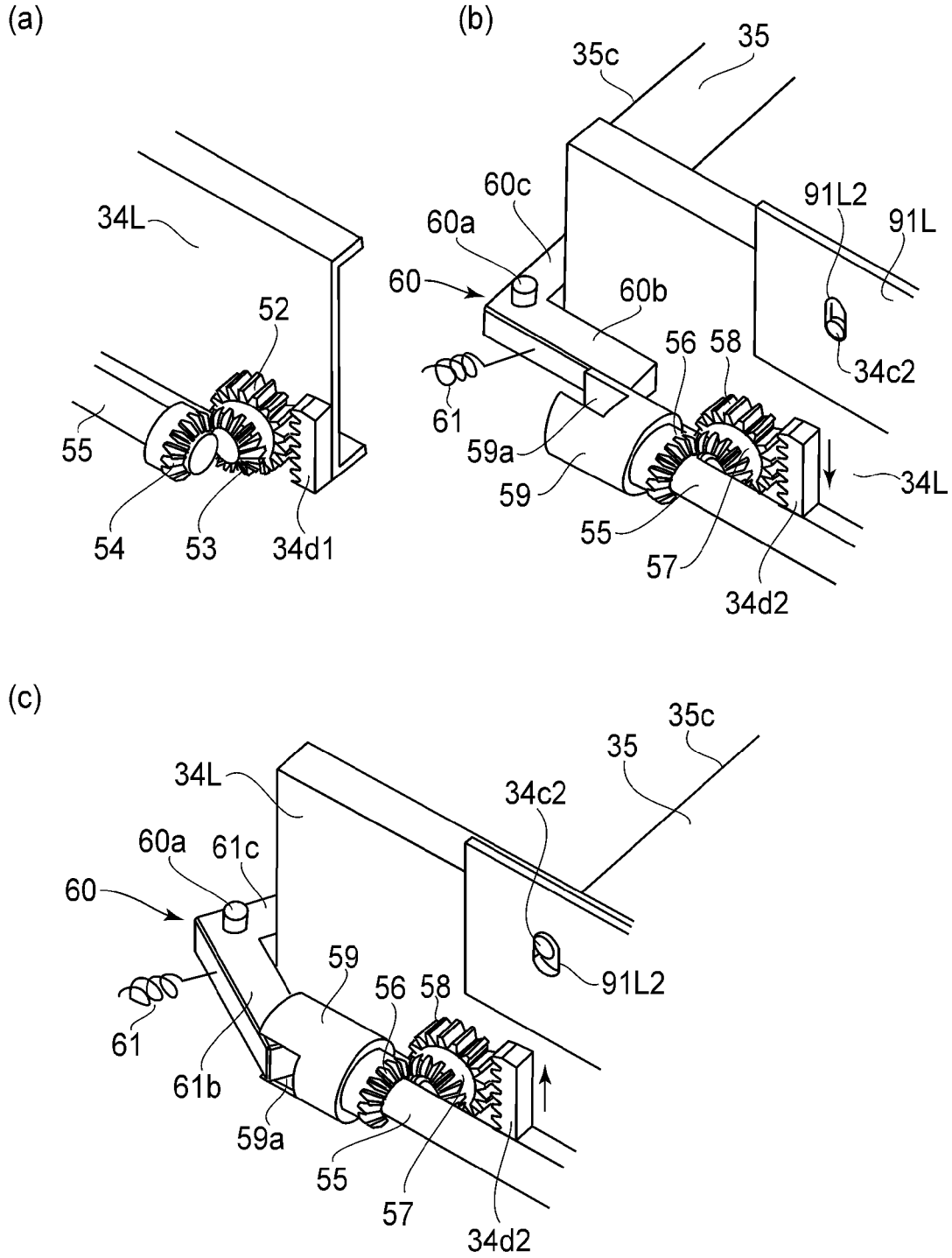
FIGS. 13(*a*), 13(*b*) and 13(*c*) are partly enlarged views each for illustrating the left side interrelating mechanism.

FIG. 14(*b*) shows a state in which the door 31 placed in the state shown in FIG. 13(*a*) is opened as also shown in FIG. 3. When jam occurs on the front surface side of the image forming apparatus, the user is not required to operate the grip member 36 for jam clearance but is only required to open the door 31 as shown in FIG. 14(*b*).

FIG. 14(*c*) shows a state in which the grip member 36 placed in the state shown in FIG. 14(*b*) is rotated forward substantially 90 degrees to be placed in the opened state. In the process of the forward rotation of the grip member 36 from the closed state to the opened state, the first left spur gear 51L and the first right spur gear 51R are also rotated forward together with the grip member 36. Further, in interrelation with the forward rotation of the first left spur gear 51L, the second spur gear 52, the first bevel gear 53, the second bevel gear 54, the shaft 55, the third bevel gear 56, the fourth spur gear 58, and the bifurcated member 59 of the left side interrelating mechanism are rotated forward. A final forward rotation angle of these members is substantially 90 degrees corresponding to that of the forward rotation of the grip member 36. Hereinafter, a forward rotation operation of these members is referred to as a forward rotation operation of the left side interrelating mechanism By the forward rotation of the second spur gear 52 and the fourth spur gear 58, the racks 34*d*1 and 34*d*2 are upwardly moved. As a result, the left side tray holding member 34L is upwardly moved with the pins 34*c*1 and 34*c*2 guided by the guide holes 91L1 and 91L2. That is, the tray holding member 34L is moved from the first position to the second position. The pins 34*c*1 and 34*c*2 are located at the upper portion of the guide holes 91L1 and 91L2 by the upward movement of the tray holding member 34L.

Further, in interrelation with the forward rotation of the first right spur gear 51R, the right side interrelating mechanism performs the forward rotation operation similarly as the left side interrelating mechanism. As a result, the right side tray holding member 34R is also upwardly moved similarly as the left side tray holding member 34L. That is, the tray holding member 34R is also moved from the first position to the second position.

The above-described upward movement state of the left and right tray holding members 34L and 34R is retained so long as the grip member 36 is held in the opened state.

Figure 12:
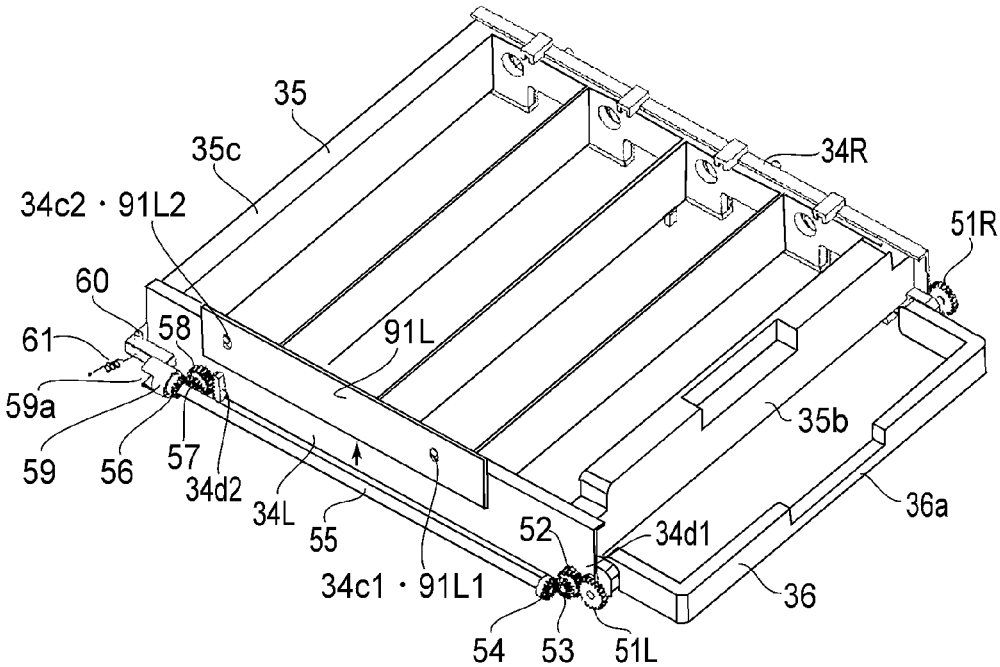
FIG. 12 is an outer appearance perspective view of the left and right tray holding members, the left side interrelating mechanism, and the tray placed in the state in which the grip member is in the opened state.

Further, by the forward rotation operation of the left and right interrelating mechanisms, the bifurcated member 59 of each of the left and right interrelating mechanisms is placed in the rotation angle state in which the bifurcated portion 59*a* is horizontally directed as shown in FIG. 12.

In the above-described upward movement process of the left and right tray holding members 34L and 34R, with respect to each cartridge, the drum driving coupling and the developing device driving coupling are disengaged. Further, the urging positioning of each cartridge by the urging member is also released.

Further, electrical connection between the electrical contact 55 and the electric energy supplying system on the apparatus main assembly side is released.

Further, when the tray holding members 34L and 34R are moved from the first position to the second position, the tray 35 and each cartridge P are also moved upward together with the tray holding members 34L and 34R, so that the drum 1 is separated from the belt 13 (FIG. 5). That is, the tray 35 is moved from the transfer contact position (inside position shown in FIG. 2) in which the drum 1 and the belt 13 contact each other to the transfer separation position (pushed-in position) (FIG. 5) in which the drum 1 and the belt 13 are separated from each other. Further, by the upward movement of the tray 35, the pin 111 is completely disengaged from the U-shaped groove as shown in FIGS. 14(*c*) and 15(*b*), so that the positioning state of the tray 35 is released. Therefore, the tray 35 can be freely subjected to the horizontal slide movement operation in the front-rear direction with respect to the left and right tray holding members 34L and 34R placed in the state in which the members 34L and 34R are moved to the second position.

The groove 110 and the pin 111 constitute the tray movement preventing means for preventing the tray 35 as the movable member from moving from the set position in the apparatus main assembly to a direction intersecting the direction in which the drum 1 of each cartridge and the belt 13 contact each other. The prevention of the movement of the tray 35 by the tray movement preventing means 110 and 111 is released after the tray 35 follows the movement of the left and right tray holding members 34L and 34R as the movable means in the direction. In this state, the tray 35 is horizontally slid and moved in the front-rear direction with respect to the tray holding members 34L and 34R to take the pulled-out position in which each cartridge is exchangeable and the set position in which each cartridge is set inside the apparatus main assembly.

From the state of FIG. 14(*c*), the opened-state grip member 36 is gripped and the tray 35 is pulled out to slide with respect to the tray holding members 34L and 34R, so that the tray 35 is horizontally slid and moved in the front direction. By the forward movement of the tray 35, the rear frame 35*c* of the tray 35 is escaped from the other arm 60*c* of the stopper member 60 of each of the left and right interrelating mechanisms. As a result, the stopper member 60 is rotated about the vertical shaft 60*a* by the pulling force of the spring 61, so that one arm 61*b* of the stopper member 60 enter the bifurcated portion 59*a* of the bifurcated member 59 to engage with the bifurcated member 59 as shown in FIG. 13(*c*). By this engagement, the shaft 55 of each of the left and right interrelating mechanisms is placed in a state in which the shaft 55 is prevented from being rotated, so that the state of the movement of the left and right tray holding members 34L and 34R to the second position is retained. That is, even when the first left spur gear 51L and the first right spur gear 51R are separated from the second left spur gear and the second spur gears of the left and right interrelating mechanisms, respectively, the state of the movement of the left and right tray holding members 34L and 34R to the second position is retained. The bifurcated member 59 is urged toward the stopper member 60 by an urging means (not shown), so that a time required for engagement between the arm portion 61*b* and the bifurcated member 59 is shorter than a time required for disengagement between the spur gear 51L (51R) and the spur gear 52.

As shown in FIGS. 6 and 7, the tray 35 is sufficiently pulled out to the predetermined pulled-out position outside the apparatus main assembly 100A. When a cartridge, to be exchanged, of the cartridges held on the tray 35 is exchanged, the user sufficiently pushes and moves the tray 35 into the apparatus main assembly to be accommodated at the pushed-in position. That is, the tray 35 is returned to the state before the pulling out as shown in FIGS. 4 and 5.

A first left spur gear 51L and a first right spur gear 51R of the tray 35 are engaged with the second spur gear 52 (FIG. 14(*c*)) of the left side interrelating mechanism and the second spur gear of the right side interrelating mechanism (not shown). The other arm portion 60*c* of the stopper member 60 of each of the left and right interrelating mechanisms is urged rearward by the rear end surface of the rear frame 35*c* of the tray 35 located at the pushed-in position. As a result, each of the stopper portions 60 of the left and right interrelating mechanisms is held in a rotation angle state (disengaged state) in which one arm portion 60*b* is escaped from the bifurcated member 59 against a pulling force of the spring 61 with the vertical shaft 60*a* as a center. That is, prevention of the rotation of the shafts of the left and right interrelating mechanisms is released.

The grip member 36 placed in the opened state is rotated backward substantially 90 degrees to be returned to the closed state. In the process of the backward rotation of the grip member 36 from the opened state to the closed state, the first left spur gear 51L and the first right spur gear 51R are also rotated backward together with the grip member 36. Further, in interrelation with the backward rotation of the first left spur gear 51L, the second spur gear 52, the first bevel gear 53, the second bevel gear 54, the shaft 55, the third bevel gear 56, the fourth spur gear 58, and the bifurcated member 59 of the left side interrelating mechanism are rotated backward. A final backward rotation angle of these members is substantially 90 degrees corresponding to that of the backward rotation of the grip member 36. Hereinafter, a backward rotation operation of these members is referred to as a backward rotation operation of the left side interrelating mechanism. By the backward rotation of the second spur gear 52 and the fourth spur gear 58, the racks 34*d*1 and 34*d*2 are downwardly moved. As a result, the left side tray holding member 34L is downwardly moved with the pins 34*c*1 and 34*c*2 guided by the guide holes 91L1 and 91L2. That is, the tray holding member 34L is moved from the second position to the first position. The pins 34*c*1 and 34*c*2 are located at the lower portion of the guide holes 91L1 and 91L2 by the downward movement of the tray holding member 34L.

Further, in interrelation with the backward rotation of the first right spur gear 51R, the right side interrelating mechanism performs the backward rotation operation similarly as the left side interrelating mechanism. As a result, the right side tray holding member 34R is also downwardly moved similarly as the left side tray holding member 34L. That is, the tray holding member 34R is also moved from the second position to the first position.

Further, the shaft 55 of each of the left and right interrelating mechanisms is placed in the rotation angle state in which the bifurcated portion 59*a* of the bifurcated member 59 is upwardly directed (FIG. 13(*b*)).

When the tray holding members 34L and 34R are moved from the second position to the first position, the tray and each cartridge P are also moved downwardly together with the tray holding members 34L and 34R, so that the drum 1 contacts the belt 13 (FIG. 2). That is, the tray 35 is moved from the transfer separation position (pushed-in position) (FIG. 5) in which the drum 1 and the belt 13 are separated from each other to the transfer contact position (FIG. 2) in which the drum 1 and the belt 13 are brought into contact with each other.

Further, in interrelation with the downward movement of the tray holding members 34L and 34R, each cartridge is urged by the urging member to be held in the state in which the cartridge is fixed (locked) to the predetermined positioning portion. To the drive input portion of the cartridge, the drive output portion on the apparatus main assembly side is connected. To the electrical contacts of the cartridge, the electric energy supplying system on the apparatus main assembly side is electrically connected. Further, by the downward movement of the tray 35, the pin 111 is engaged in the U-shaped groove 110 as shown in FIGS. 14(*b*) and 15(*a*). As a result, the movement of the tray 35 in the front-rear direction is prevented, so that the tray 35 is positioned to the apparatus main assembly 100A.

Finally, the opened door 31 is closed to complete the cartridge exchanging operation.

In this embodiment, an unshown latch mechanism is used, so that when the grip member 36 is operated from the opened state to the closed state, the grip member 36 can be placed in a partly opened state which is an intermediary state therebetween in some cases. In such cases, the following effect can be achieved by disposing the rotation center 31*b* of the door 31 outside the rotation centers 36*c*L and 36*c*R of the grip member 36. That is, in the state of FIG. 14(*c*), by closing the door 31, the grip member 36 is interrelated with the door 31 and can also be closed at the same time. Therefore, the user can return the tray holding members from the state of the FIG. 14(*c*) to the state of FIG. 14(*a*) only by the operation of the door 31.

The constitutions of the grip member and the left and right interrelating mechanisms are not limited to those described above but may also be replaced with various appropriate constitutions. Further, the constitution for retaining the state of the movement of the left and right tray holding members 34L and 34R to the second position is not limited to the above-described combination of the L-shaped stopper member 60 and the bifurcated member 59. For example, by providing the guide range of the guide holes 91 with latitude with respect to the horizontal direction, the left and right tray holding members 34L and 34R may also be prevented from being downwardly moved from the second position to the first position.

As described above, in order to improve the usability, the cartridge is placed on the movable member (the tray) and is exchanged and the movable member is upwardly and downwardly moved by the vertical movement of the movable means (the tray holding member). The movable means is moved in interrelation with the forward and backward rotations of the tray grip member and is supported by the door 31 at the pulled-out position on the front side of the apparatus main assembly.

As a result, it is possible to provide an image forming apparatus, provided with a pull-out type process cartridge exchange constitution, having prevented an occurrence of damage and memory caused by rubbing between the belt 13 and the drum 1 of each cartridge P without increasing a size and cost of the apparatus main assembly 100A.

(Interface Portions)

Interface portions will be described.

Figure 16:
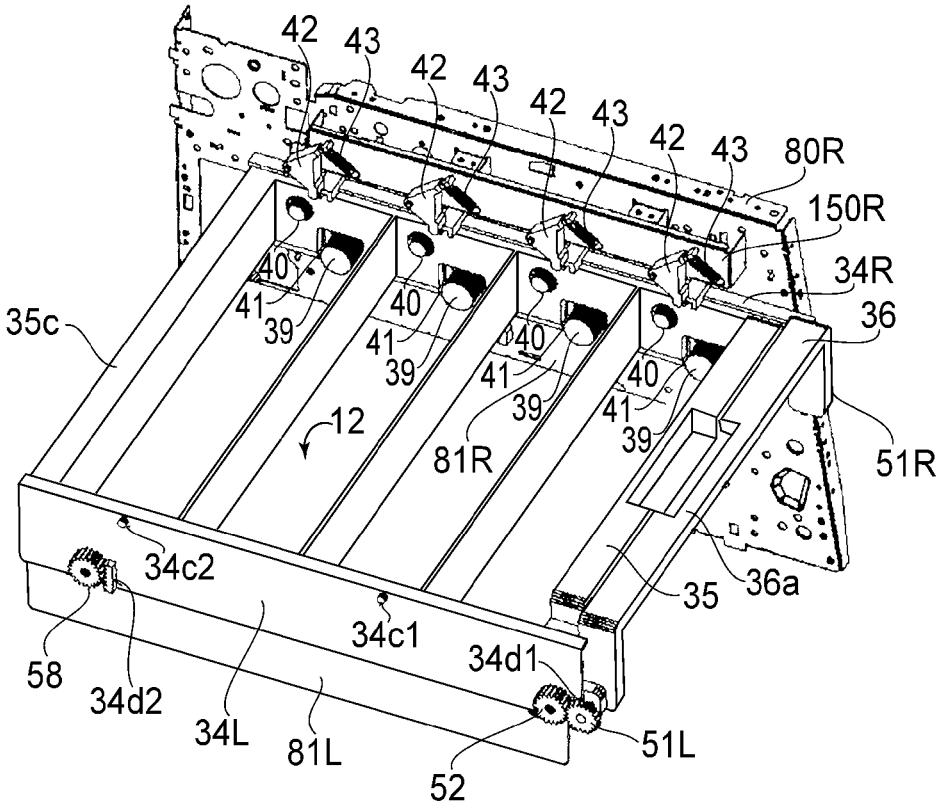
FIGS. 16, 17, and 18(*a*) and 18(*b*) are schematic views each for illustrating interface portions, located adjacent to the cartridge, for releasing pressure application to and engagement with the cartridge in interrelation with the tray holding member.
Figure 17:
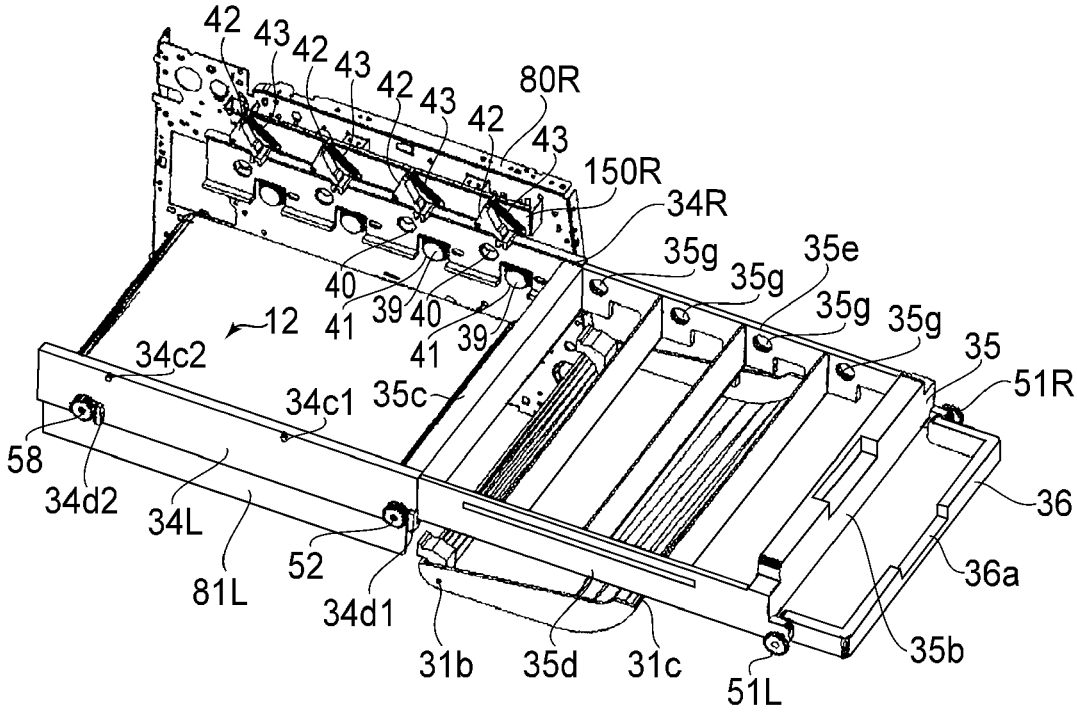
Figure 18:
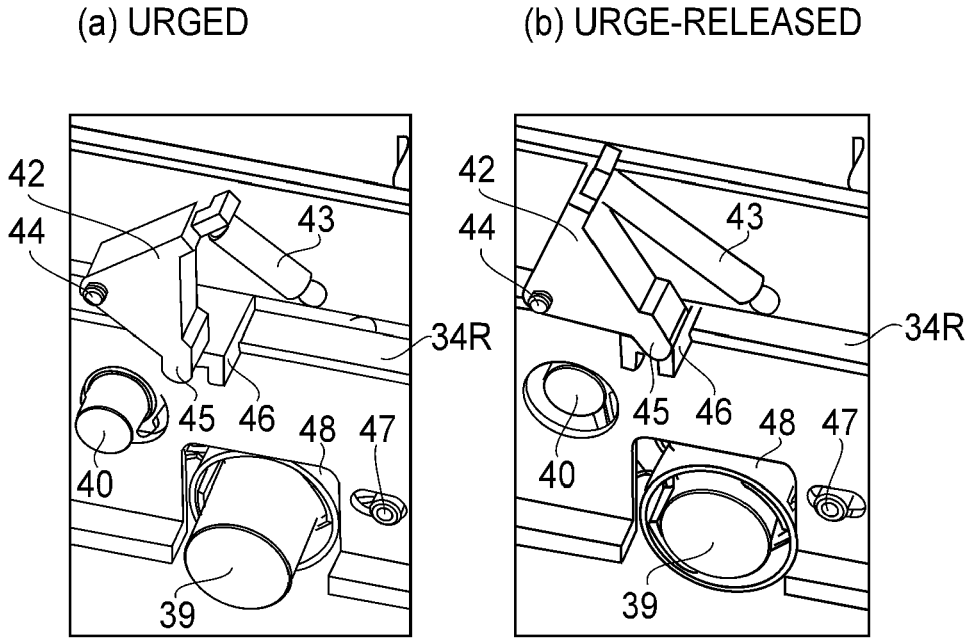

FIGS. 16 to 18 are schematic views for illustrating the interface portions in the neighborhood of each cartridge, which are interrelated with the tray holding members 34L and 34R to perform disengagement or release operation.

FIG. 16 is a perspective view showing a state (closed state) in which the grip member 36 is rotated backward and no cartridge is in the tray 35. FIG. 17 is a perspective view showing a state (opened state) in which the grip member 36 is rotated forward and the tray 35 has been pulled out.

On the right side in the apparatus main assembly, the drum driving (force transmitting) couplings 39 and the developing device driving (force transmitting) couplings 40 as the drive output portions on the apparatus main assembly side, which are connected with the drive input portions 53 and 54 (FIG. 8(*a*)) on the cartridge side, in order to rotationally drive the drum 1 and developing roller 3*a*, respectively, in each cartridge.

On both the left and right sides in the apparatus main assembly 100A, positioning portions for receiving the lower surface portions (to be positioned) of driving-side shaft-supporting portions 51 and non-driving-side shaft-supporting portions 52 of each cartridge are provided to the stay members 81L and 81R.

Also on both the left and right sides in the apparatus main assembly, urging members 42 for urging the left and right side upper surfaces of the corresponding cartridge so that the driving-side shaft-supporting portions 51 and the non-driving-side shaft-supporting portions can be engaged and fixed in the positioning portions 41 (the left side urging member is not shown). Each urging member 42 is provided with a spring for generating a pressing force.

FIG. 18(*a*) is an enlarged view of the urging member 42, the drum driving coupling 39, and the developing device driving coupling 40, which are in the state shown in FIG. 16. FIG. 18(*b*) is an enlarged view of the urging member 42, the drum driving coupling 39, and the developing device driving coupling 40, which are in the state shown in FIG. 17.

The urging member 42 is rotatably provided to the apparatus main assembly 100A with a supporting point 44, and urges the right (or left) end upper surface of the corresponding cartridge by a spring force of an urging spring 43. That is, the positioning portion 41 is provided along the movement direction of the tray 35 and at the positioning portion 41, the cartridge P is urged by the urging member 42 in a direction substantially perpendicular to the movement direction of the tray 35 to be placed in the positioned state (locked state). In an urge-released state shown in FIG. 18(*b*), a lever portion 45 of the urging member 42 has been pushed up by an urging member raising portion 46 provided to the tray holding member 34R, so that the pressure applied to the cartridge is removed in interrelation with the movement of the tray holding member 34R (lock-released state).

Further, a release lever pin 47 is provided to a release lever 48 (means for removing a driving force transmitted to cartridge) provided around the drum driving coupling 39 so as to retract the driving coupling 39. In interrelation with the movement of the tray holding member 34R, the release lever pin 47 is moved from the position shown in FIG. 18(*a*) to the position shown in FIG. 18(*b*). By the operation of the release lever 48, the drum driving coupling 39 and the developing device driving coupling 40 are retracted to the position shown in FIG. 18(*b*). That is, the drum driving coupling 39 and the developing device driving coupling 40 of each cartridge are released.

In the state shown in FIG. 17, that is, in a state in which the drum driving couplings 39, the developing device driving couplings 40, and the urging members 42 are released in interrelation with the motion of the tray holding members 34L and 34R, the tray 35 is slidable. Accordingly, the tray 34 is placed in such a state that it can be accommodated in and pulled out from the apparatus main assembly 100A while holding the cartridges thereon.

As described above, the left and right tray holding members 34L and 34R are operated in interrelation with the forward and backward rotation of the grip member 36. In this case, in order to reduce an operating force of the forward and backward rotation of the grip member 36, the image forming apparatus may be structured so that the timing of the urge release is slightly different from the timing of the release of the driving couplings.

That is, the drum driving coupling 39, the developing device driving coupling 40, and the urging member 42 are made slightly different in releasing timing. More specifically, the pin 47 and the urging member raising portion 46 are made different in position to render the coupling and the urging member slightly different in releasing timing for the drive and the urging, and the four cartridges are rendered slightly different in releasing timing for the drive and the urging. Thus, a load exerted on the grip member 36 is distributed. As a result, it is possible to reduce the peak load and reduce the operating force during operation of the grip member 36 by the user.

As described above, the retraction of the driving means (couplings 39 and 40) and the vertical movement of the tray 35 are performed by the movement of the tray holding members 34L and 34R, so that it is possible to integrate the mechanisms to realize a compact size of the apparatus main assembly.

The image forming apparatus 100 in this embodiment is summarized as follows.

(1) The image forming apparatus 100 forms the image on the recording material S. The image forming apparatus 100 includes the movable member 35 for supporting the cartridge P including at least one of the image bearing member 1 on which the latent image is to be formed and the developing means 3 for developing with the developer the latent image formed on the image bearing member 1. The movable member 35 can take the pulled-out position in which the movable member 35 having been pulled out to the outside of the apparatus main assembly 100A of the image forming apparatus 100 permits mounting and demounting of the cartridge outside the apparatus main assembly 100A and the inside position in which the cartridge is moved to the inside of the apparatus main assembly 100A. Further, the grip member 36 capable of being rotated forward rotated backward is provided to the movable member 35. The image forming apparatus 100 further includes the urging member 42 for placing the cartridge P in the positioned state (locked state) with respect to the positioning portion 41 of the apparatus main assembly 100A. In the state in which the movable member 35 is located in the inside position, when the grip member 36 is rotated forward by the predetermined distance, the positioned state of the cartridge P with respect to the position portion 41 by the urging member 42 is released. Further, when the grip member 36 is rotated backward by the predetermined distance, the cartridge P is positioned to the positioning portion 41 by the urging member 42.

(2) The positioning portion 41 is provided along the movement direction of the movable member 35, and the cartridge P is urged by the urging member 42 in the direction substantially perpendicular to the movement direction of the movable member 35 to be placed in the positioned state.

(3) In the state in which the movable member 35 is located at the inside position and the grip member 36 is rotated forward by the predetermined distance, when the openable door 31 is closed with respect to the apparatus main assembly 100A, the grip member 36 is rotated backward by the predetermined distance in interrelation with the motion of the openable door 31.

(4) The movable member 35 can support the plurality of the cartridges PY, PM, PC and PK side by side with respect to the movement direction thereof.

In this embodiment, the cartridges P can be easily replaced in the front access manner. The image forming apparatus is of the type in which the cartridge can be replaced in a state in which it is mounted in the tray and in which the members on the apparatus main assembly side, the cartridges can be positioned during mounting thereof, and in which the tray roughly holds the cartridge and moves between the pulled-out position and the pushed-in position. As a result, the user can set the cartridge into the tray from right above with respect to the direction of gravitation without paying attention to the positioning at the pulled-out position of the tray. Thereafter, the user pushes the tray in to the pushed-in position and rotates backward the grip member 36 to face the front surface of the tray, so that it is possible to effect the positioning of the cartridge with reliability. As a result, it is possible to provide an image forming apparatus which allows a simple operation by the user and is capable of ensuring positional accuracy for each cartridge.

When the tray 35 is operated in such a state that the tray 35 is not completely raised, e.g., in a half-open state of the grip member 36, there is a possibility of an occurrence of an image problem caused by rubbing of the drum 1 of each cartridge with the belt 13. However, in this embodiment, it is possible to realize a state in which the tray 35 cannot be operated until the user completely rotates the grip member 36, by providing the members (tray movement preventing means 110 and 111) for preventing the movement of the tray 35 by the forward and backward rotation of the grip member 36.

As described above, the image forming apparatus of this embodiment can easily perform the exchange of the cartridge by the moving operation of the tray.

In the above-described embodiment, the cartridge P is the process cartridge prepared by integrally supporting the image bearing member 1 and the process means, acting on the image bearing member 1, consisting of the charging means 2, the developing means 3 and the cleaning means 4 into a cartridge but is not limited thereto. That is, the cartridge P may only be required to include at least the image bearing member on which the latent image is to be formed and the developing means for developing the latent image, formed on the image bearing member, with the developer. The process means is, e.g., at leas one of the charging means, the developing means, and the cleaning means. The image bearing member is the member on which the latent image to be developed with the developer is to be formed. The image bearing member may also be the electrostatic recording dielectric member in the electrostatic recording process, the magnetic recording magnetic member in the magnetic recording process, and the like, in addition to the electrophotographic photosensitive member in the electrophotographic process as in the embodiment.

In the above-described embodiment, the tray 35 as the movable member is configured to support the four cartridges PY, PM, PC and PK disposed in parallel to each other with respect to the movement direction of the tray 35. However, the cartridges to be supported by the tray 35 may also be a single cartridge. Further, it is also possible to constitute the image forming apparatus in which two, three or five or more cartridge are supportable side by side on the tray 35.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 271781/2008 filed Oct. 22, 2008, which is hereby incorporated by reference.

What is claimed is:

1. An image forming apparatus for forming an image on a recording material, comprising:

a cartridge including at least one of an image bearing member on which a latent image is to be formed and developing means for developing with a developer the latent image formed on the image bearing member;

a main assembly including a positioning portion for positioning said cartridge and an urging member for urging said cartridge so that said cartridge is positioned to the positioning portion;

a movable member movable, with respect to said main assembly in a state in which said movable member supports said cartridge, between a pulled-out position in which said movable member is pulled out to an outside of said main assembly to position said cartridge outside said main assembly and an inside position in which said cartridge is positioned inside said main assembly; and a grip member, which is mounted to said movable member and which is to be gripped for pulling out said movable member, movable between a reference position and an outward position located outwardly the reference position with respect to a pull-out direction in which said movable member is pulled out from the inside position to the pulled-out position;

wherein in a state in which said movable member is located at the inside position, said cartridge is positioned to the positioning portion by the urging member to be placed in a positioning state when said grip member is located at the reference position, and wherein in the state in which said movable member is located at the inside position, the positioning state of said cartridge is released by moving said grip member from the reference position to the outward position.

2. An apparatus according to claim 1, wherein said movable member is movable between an image forming position in which image formation is to be effected and a set position spaced apart from the image forming position, and wherein the inside position includes the image forming position and the set position.

3. An apparatus according to claim 2, further including a supporting member, provided to the main assembly, for movably supporting said movable member, wherein said supporting member is movable between a first position in which said movable member is to be located at the image forming position and a second position in which said movable member is to be moved between the set position and the pulled-out position.

4. An apparatus according to claim 3, wherein in the state in which said movable member is located at the inside position, said supporting member is moved from the second position to the first position by movement of said grip member from the outward position to the reference position and said urging member positions said cartridge to the positioning portion by movement of said supporting member from the second position to the first position.

5. An apparatus according to claim 4, wherein in the state in which said movable member is located at the inside position, said supporting member is moved from the first position to the second position by movement of said grip member from the reference position to the outward position, thereby to release the positioning state of said second positioned by said urging member.

6. An apparatus according to claim 1, wherein the positioning portion is provided along a movement direction of said movable member, and said cartridge is urged and positioned by said urging member with respect to a direction substantially perpendicular to a movement direction of said movable member.

7. An apparatus according to claim 1, further comprising an openable door with respect to an opening provided to the main assembly, wherein when said openable door is closed in a state in which said movable member is located at the inside position and said grip member is located at the outward position, said grip member is moved from the outward position to the reference position in interrelation with motion of said openable door.

8. An apparatus according to claim 1, wherein said cartridge includes a plurality of cartridge portions, and wherein said movable member is capable of supporting the plurality of cartridge portions side by said with respect to a movement direction of said movable member.

* * * * *